US010482833B2

(12) United States Patent
Okamoto

(10) Patent No.: US 10,482,833 B2
(45) Date of Patent: Nov. 19, 2019

(54) OPERATION METHOD OF ELECTRONIC DEVICE

(71) Applicant: Semiconductor Energy Laboratory Co., Ltd., Kanagawa-ken (JP)

(72) Inventor: Yuki Okamoto, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 15/805,589

(22) Filed: Nov. 7, 2017

(65) Prior Publication Data

US 2018/0130434 A1 May 10, 2018

(30) Foreign Application Priority Data

Nov. 9, 2016 (JP) ..... 2016-218498

(51) Int. Cl.
*G09G 3/36* (2006.01)
*G09G 3/32* (2016.01)
(Continued)

(52) U.S. Cl.
CPC ..... *G09G 3/3648* (2013.01); *G09G 3/20* (2013.01); *G09G 3/32* (2013.01); *G09G 3/3607* (2013.01);
(Continued)

(58) Field of Classification Search
CPC ..... G09G 3/3648; G09G 3/20; G09G 3/32; G09G 3/3607; G09G 2300/046; G09G 2320/066; G09G 2360/144
See application file for complete search history.

(56) References Cited

U.S. PATENT DOCUMENTS 6,714,268 B2 3/2004 Wang et al.
7,038,641 B2 5/2006 Hirota et al.
(Continued)

FOREIGN PATENT DOCUMENTS

JP 2001-066593 A 3/2001
JP 2002-196702 A 7/2002
(Continued)

OTHER PUBLICATIONS

Shieh, H-P., "Transflective Display by Hybrid OLED and LCD," LEOS 2005 (IEEE Lasers and Electro-Optics Society Annual Meeting) , Oct. 22, 2005, pp. 650-651, IEEE.
(Continued)

*Primary Examiner* — Stephen G Sherman
(74) *Attorney, Agent, or Firm* — Husch Blackwell LLP

(57) ABSTRACT

An operation method of a display device with high visibility is to be provided. The display device is an electronic device including a first display element, a second display element, an optical sensor, and a gain calculation circuit. In the electronic device, the illuminance of external light is obtained with the optical sensor, and depending on the illuminance, images displayed using the first display element and the second display element are corrected. The gain calculation circuit obtains the illuminance and calculates a gain value depending on the illuminance. In particular, the gain value is calculated for each of the first display element and the second display element. Furthermore, the gain calculation circuit performs dimming and toning on image data displayed using the first display element and the second display element by multiplying the image data by the gain values or values corresponding to the gain values.

13 Claims, 16 Drawing Sheets

(51) Int. Cl.
*G09G 3/30* (2006.01)
*G09G 3/20* (2006.01)

(52) U.S. Cl.
CPC . *G09G 2300/046* (2013.01); *G09G 2320/066* (2013.01); *G09G 2360/144* (2013.01)

(56) References Cited

U.S. PATENT DOCUMENTS

| | | | | |
|---|---|---|---|---|
| 7,084,936 | B2 | 8/2006 | Kato | |
| 7,102,704 | B2 | 9/2006 | Mitsui et al. | |
| 7,176,991 | B2 | 2/2007 | Mitsui et al. | |
| 7,239,361 | B2 | 7/2007 | Kato | |
| 7,248,235 | B2 | 7/2007 | Fujii et al. | |
| 7,385,654 | B2 | 6/2008 | Mitsui et al. | |
| 8,786,209 | B2 | 7/2014 | Takahashi | |
| 9,360,704 | B2 | 6/2016 | Fukutome | |
| 9,805,676 | B2 | 10/2017 | Koyama et al. | |
| 9,851,820 | B2 | 12/2017 | Yamazaki et al. | |
| 2003/0107688 | A1 | 6/2003 | Yamagishi | |
| 2003/0201960 | A1 | 10/2003 | Fujieda | |
| 2004/0119676 | A1* | 6/2004 | Nam | G09G 3/3648 345/87 |
| 2006/0072047 | A1 | 4/2006 | Sekiguchi | |
| 2006/0119612 | A1* | 6/2006 | Kerofsky | G09G 3/22 345/590 |
| 2007/0075935 | A1 | 4/2007 | Mesmer et al. | |
| 2007/0222730 | A1* | 9/2007 | Kao | G09G 3/2059 345/89 |
| 2007/0291048 | A1* | 12/2007 | Kerofsky | G09G 3/3406 345/589 |
| 2008/0180618 | A1 | 7/2008 | Fujieda | |
| 2008/0284720 | A1 | 11/2008 | Fukutome | |
| 2010/0171905 | A1 | 7/2010 | Huang et al. | |
| 2016/0283028 | A1 | 9/2016 | Yamazaki et al. | |
| 2016/0299387 | A1 | 10/2016 | Yamazaki et al. | |
| 2016/0358986 | A1 | 12/2016 | Yamazaki et al. | |
| 2017/0031471 | A1 | 2/2017 | Yamazaki et al. | |
| 2017/0040402 | A1 | 2/2017 | Yasumoto et al. | |
| 2018/0033398 | A1 | 2/2018 | Okamoto | |

FOREIGN PATENT DOCUMENTS

| | | | |
|---|---|---|---|
| JP | 2002-328630 | A | 11/2002 |
| JP | 2003-076302 | A | 3/2003 |
| JP | 2003-157026 | A | 5/2003 |
| JP | 2003-157029 | A | 5/2003 |
| JP | 2003-228304 | A | 8/2003 |
| JP | 2003-316295 | A | 11/2003 |
| JP | 2003-322850 | A | 11/2003 |
| JP | 2004-296162 | A | 10/2004 |
| JP | 2007-232882 | A | 9/2007 |
| JP | 2008-225381 | A | 9/2008 |
| JP | 4161574 | B2 | 10/2008 |
| JP | 2013-221965 | A | 10/2013 |
| WO | WO 2004/053819 | A1 | 6/2004 |
| WO | WO 2007/041150 | A1 | 4/2007 |

OTHER PUBLICATIONS

Lee, J-H. et al., "High Ambient-Contrast-Ratio Display Using Tandem Reflective Liquid Crystal Display and Organic Light-Emitting Device," Optics Express, Nov. 14, 2005, vol. 13, No. 23, pp. 9431-9438.

* cited by examiner

OPERATION METHOD OF ELECTRONIC DEVICE

BACKGROUND OF THE INVENTION

1. Field of the Invention

One embodiment of the present invention relates to an operation method of an electronic device.

Note that one embodiment of the present invention is not limited to the above technical field. The technical field of the invention disclosed in this specification and the like relates to an object, a method, or a manufacturing method. In addition, one embodiment of the present invention relates to a process, a machine, manufacture, or a composition of matter. Specifically, examples of the technical field of one embodiment of the present invention disclosed in this specification include a semiconductor device, a display device, a liquid crystal display device, a light-emitting device, a power storage device, an imaging device, a memory device, a processor, an electronic device, a system, a method for driving any of them, a method for manufacturing any of them, a method for testing any of them, and a method for inspecting any of them.

2. Description of the Related Art

Display devices included in mobile phones such as smartphones, tablet information terminals, notebook personal computers (PC), and portable game consoles have undergone various improvements in recent years. For example, there have been developed display devices with purposes such as higher resolution, higher color reproducibility (higher NTSC ratio), a smaller driver circuit, and lower power consumption.

As an example, an improved display device has a function of automatically adjusting the brightness of an image displayed on the display device in accordance with ambient light. An example of such a display device is a display device having a function of displaying an image by reflecting ambient light and a function of displaying an image by making a light-emitting element emit light. This structure enables the brightness of an image displayed on a display device to be adjusted in the following manner: the display device enters a display mode for displaying an image with use of reflected light (hereinafter referred to as first mode) when ambient light is sufficiently strong, whereas the display device enters a display mode for displaying an image with light emitted from a light-emitting element (hereinafter referred to as second mode) when ambient light is weak. In other words, the display device can display images in a display mode that is selected from the first mode, the second mode, and a mode using both the first and second modes (hereinafter referred to as hybrid display or third mode) in accordance with the intensity of ambient light sensed with an illuminometer (illuminance sensor).

As examples of a display device having a function of displaying an image by making a light-emitting element emit light and a function of displaying an image by reflecting ambient light, Patent Documents 1 to 3 each disclose a display device in which one pixel includes a pixel circuit for controlling a liquid crystal element and a pixel circuit for controlling a light-emitting element.

As described above, a display including a light-emitting element (such as a transmissive liquid crystal element, an organic EL, an inorganic EL, or a nitride semiconductor light-emitting diode) and a reflective element (such as a reflective liquid crystal element) as display elements is called an emissive OLED and reflective LC hybrid display or an emission/reflection hybrid display (ER-hybrid display) in this specification. A display including a transmissive liquid crystal element and a reflective liquid crystal element as display elements is called a transmissive LC and reflective LC hybrid display or a transmission/reflection hybrid display (TR-hybrid display). A display device including a light-emitting element and a reflective element as display elements is called a hybrid display device, and a display including the hybrid display device is called a hybrid display.

REFERENCE

Patent Document

[Patent Document 1] United States Patent Application Publication No. 2003/0107688

[Patent Document 2] PCT International Publication No. WO2007/041150

[Patent Document 3] Japanese Published Patent Application No. 2008-225381

SUMMARY OF THE INVENTION

In order that a hybrid display device has display quality that is independent of environment light, it is necessary to adjust the luminance and correct the color tone in accordance with the usage environment. For example, when the brightness of external light changes, it is necessary to adjust the luminance of a hybrid display device and correct the color tone, depending on the brightness.

An object of one embodiment of the present invention is to provide a novel operation method of an electronic device including a hybrid display device. Another object of one embodiment of the present invention is to provide a system of the electronic device. Another object of one embodiment of the present invention is to provide an electronic device with low power consumption. Another object of one embodiment of the present invention is to provide an electronic device with high display quality.

Note that the objects of one embodiment of the present invention are not limited to the above objects. The objects described above do not disturb the existence of other objects. The other objects are the ones that are not described above and will be described below. The other objects will be apparent from and can be derived from the description of the specification, the drawings, and the like by those skilled in the art. One embodiment of the present invention achieves at least one of the above objects and the other objects. One embodiment of the present invention does not necessarily achieve all the above objects and the other objects.

(1)

One embodiment of the present invention is an operation method of an electronic device including a first display element, a second display element, a first circuit, and an optical sensor, which includes first to eighth steps. The first circuit is configured to determine a first gain value and a second gain value. The first step includes a step in which an illuminance of external light is measured with the optical sensor and a step in which an illuminance data including the illuminance of the external light is transmitted to the first circuit. The second step includes a step in which the first circuit obtains a first data and a second data. The third step includes a step in which the operation proceeds to the fourth step when the illuminance of the external light in the first circuit is lower than a first illuminance, a step in which the operation proceeds to the fifth step when the illuminance of the external light in the first circuit is higher than or equal to the first illuminance and lower than a second illuminance, and a step in which the operation proceeds to the sixth step when the illuminance of the external light in the first circuit is higher than or equal to the second illuminance. The fourth step includes a step in which the first circuit sets the first gain value to 0 and a step in which the first circuit determines the second gain value with use of a first function and the illuminance of the external light. The fifth step includes a step in which the first circuit determines the first gain value with use of a second function and the illuminance of the external light and a step in which the first circuit determines the second gain value with use of a third function and the illuminance of the external light. The sixth step includes a step in which the first circuit determines the first gain value with use of a fourth function and the illuminance of the external light and a step in which the first circuit sets the second gain value to 0. The seventh step includes a step in which the first gain value or a value corresponding to the first gain value is multiplied by the first data to generate a third data in the first circuit and a step in which the second gain value or a value corresponding to the second gain value is multiplied by the second data to generate a fourth data in the first circuit. The eighth step includes a step in which an image based on the third data is displayed using the first display element and a step in which an image based on the fourth data is displayed using the second display element.

(2)

Another embodiment of the present invention is the operation method according to (1), where at least one of the first to fourth functions is a linear function.

(3)

Another embodiment of the present invention is the operation method according to (2), further including a ninth step and a tenth step. The ninth step includes a step in which the first gain value determined in any of the fourth to sixth steps is set to a first maximum value when the first gain value is greater than or equal to the first maximum value. The tenth step includes a step in which the second gain value determined in any of the fourth to sixth steps is set to a second maximum value when the second gain value is greater than or equal to the second maximum value-. After the ninth step and the tenth step are conducted, the seventh step is conducted.

(4)

Another embodiment of the present invention is the operation method according to (3), further including an eleventh step. The electronic device includes a second circuit. The eleventh step includes a step in which correction processing is performed on one of the first data and the third data and one of the second data and the fourth data.

(5)

Another embodiment of the present invention is the operation method according to (4), where the correction processing includes gamma correction processing.

(6)

Another embodiment of the present invention is the operation method according to any one of (1) to (5), where the first display element is a reflective element and the second display element is a light-emitting element.

According to one embodiment of the present invention, a novel operation method of an electronic device including a hybrid display device can be provided. According to another embodiment of the present invention, a system of the electronic device can be provided. According to another embodiment of the present invention, an electronic device with low power consumption can be provided. According to another embodiment of the present invention, an electronic device with high display quality can be provided.

Note that the effects of one embodiment of the present invention are not limited to the above effects. The effects described above do not disturb the existence of other effects. The other effects are the ones that are not described above and will be described below. The other effects will be apparent from and can be derived from the description of the specification, the drawings, and the like by those skilled in the art. One embodiment of the present invention has at least one of the above effects and the other effects. Accordingly, one embodiment of the present invention does not have the aforementioned effects in some cases.

DETAILED DESCRIPTION OF THE INVENTION

In this specification, hybrid display (display in the third mode) is a method for displaying a letter or an image using reflected light and self-emitted light together in one panel which complement the color tone or light intensity of each other. Alternatively, hybrid display is a method for displaying a letter and/or an image using light from a plurality of display elements in one pixel or one subpixel. Note that when a hybrid display device performing hybrid display is locally observed, a pixel or a subpixel performing display using any one of the plurality of display elements and a pixel or a subpixel performing display using two or more of the plurality of display elements are included in some cases.

Note that in the present specification and the like, hybrid display satisfies any one or a plurality of the above-described descriptions.

Furthermore, a hybrid display includes a plurality of display elements in one pixel or one subpixel. Note that as an example of the plurality of display elements, a reflective element that reflects light and a self-luminous element that emits light can be given. Note that the reflective element and the self-luminous element can be controlled independently. A hybrid display has a function of displaying a letter and/or an image using one or both of reflected light and self-emitted light in a display portion.

In this specification and the like, an "image" is a term including both a still image and a moving image. In other words, in this specification and the like, an "image" can refer to either a still image or a moving image.

In this specification and the like, a metal oxide means an oxide of metal in a broad sense. Metal oxides are classified into an oxide insulator, an oxide conductor (including a transparent oxide conductor), an oxide semiconductor (also simply referred to as an OS), and the like. For example, a metal oxide used in an active layer of a transistor is called an oxide semiconductor in some cases. That is to say, when a metal oxide is included in a channel formation region of a transistor that has at least one of an amplifying function, a rectifying function, and a switching function, the metal oxide can be called a metal oxide semiconductor, or OS for short. An OS transistor refers to a transistor including a metal oxide or an oxide semiconductor.

In this specification and the like, a metal oxide including nitrogen is also called a metal oxide in some cases. Moreover, a metal oxide including nitrogen may be called a metal oxynitride.

Embodiment 1

In this embodiment, a semiconductor device that performs correction processing on an image displayed on a hybrid display device will be described.

<Structure Example>

Figure 1A:
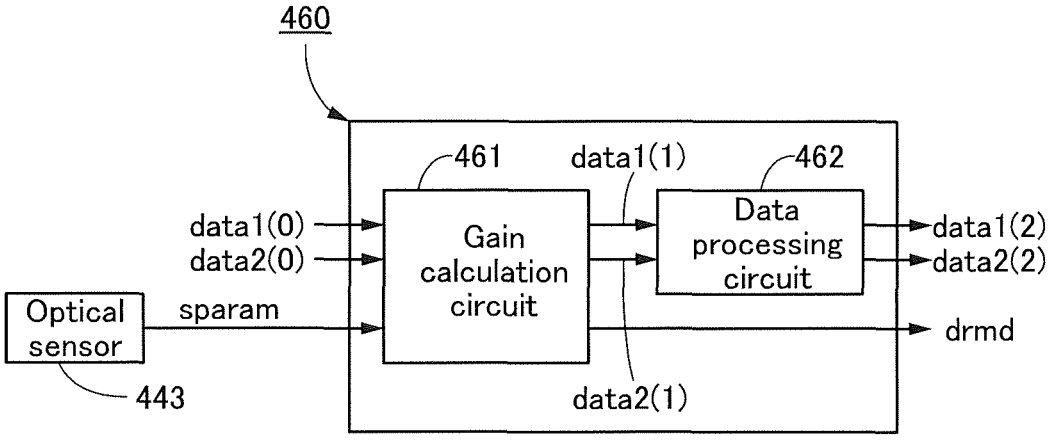
FIGS. 1A and 1B are each a block diagram illustrating a configuration example of an image processing portion.

FIG. 1A is a block diagram illustrating a structure example of a semiconductor device that performs image processing and a peripheral device of the semiconductor device. An image processing portion 460 is a device that performs gamma correction, dimming, toning, or the like on an image displayed on a hybrid display device.

The dimming here refers to processing in which the brightness of an image displayed on the hybrid display device is adjusted in accordance with the illuminance of external light in an environment where an electronic device including the hybrid display device is used. Note that the brightness of a displayed image is determined by the reflective intensity of a reflective element, the emission intensity of a light-emitting element, or the like.

The toning here refers to processing in which a color tone of an image displayed on the hybrid display device is adjusted in accordance with a color of external light in an environment where an electronic device including the hybrid display device is used. As an example of a method for adjusting a color tone, there is a method in which emission of a light-emitting element compensates for a component of a color that is not sufficient with the display by a reflective element. For example, in the case where the electronic device is used in a reddish environment at evening, a blue (B) component or a green (G) component is not sufficient or both of the components are not sufficient only with the display by the reflective element; thus, the color tone of the image can be adjusted by making the light-emitting element emit light of insufficient colors.

The gamma correction here refers to correction processing that is performed on image data displayed using a display element (liquid crystal element) and that optimizes the brightness of a screen in accordance with characteristics of the liquid crystal element.

The image processing portion 460 has a function of obtaining image data to be displayed on the hybrid display device from the outside of the image processing portion 460 and performing the above-described correction on the image data. In addition, the image processing portion 460 has a function of outputting the corrected image data to the outside.

In FIG. 1A, as the image data transmitted to the image processing portion 460, data 1(0) and data 2(0) are shown. The data 1(0) and the data 2(0) are transmitted from a host device, for example. The data 1(0) is image data to be displayed using a first display element of the hybrid display device, and the data 2(0) is image data to be displayed using a second display element of the hybrid display device. In this specification, the first display element is a reflective element for displaying an image on the display device utilizing reflected light, and the second display element is a light-emitting element for displaying an image on the display device utilizing emitted light.

In addition, in FIG. 1A, as the image data outputted from the image processing portion 460, data 1(2) and data 2(2) are shown. The data 1(2) is image data obtained by correcting the data 1(0) in the image processing portion 460, and the data 2(2) is image data obtained by correcting the data 2(0) in the image processing portion 460. The data 1(2) is transmitted to the first display element, and the data 2(2) is transmitted to the second display element.

Next, circuits inside the image processing portion 460 and a peripheral device of the image processing portion 460 are described. The image processing portion 460 includes a gain calculation circuit 461 and a data processing circuit 462. The image processing portion 460 is electrically connected to an optical sensor 443.

The optical sensor 443 has a function of measuring the illuminance of external light. In particular, the optical sensor 443 measures the illuminance of each of red (R) light, green (G) light, and blue (B) light included in the external light, and transmits data of each illuminance as a signal sparam to the gain calculation circuit 461 in the image processing portion 460. In FIG. 1A, a state where the signal sparam is transmitted directly from the optical sensor 443 to the gain calculation circuit 461 is shown. However, in actual operation in some cases, data of the illuminance from the optical sensor 443 is converted into the signal sparam by a processor, a sensor controller, or the like in the host device, a display controller, or the like, and then transmitted to the gain calculation circuit 461.

The gain calculation circuit 461 has a function of calculating products of each of the data 1(0) and the data 2(0) transmitted to the image processing portion 460 and respective gain values or values corresponding to the gain values. Specifically, the gain value of the data 1(0) is $G_1$ and the gain value of the data 2(0) is $G_2$.

Strictly, the calculation of product of the data 1(0) and the gain value $G_1$ is performed for each of colors R, G, and B. Assuming that the luminance and the gain values of R, G, and B from pixels displaying an image of the data 1(0) are represented by $L_{1R}$, $L_{1G}$, and $L_{1B}$ and $G_{1R}$, $G_{1G}$, and $G_{1B}$, respectively, the products of the data 1(0) and the gain value $G_1$ can be represented by $L_{1R}\times G_{1R}$, $L_{1G}\times G_{1G}$, and $L_{1B}\times G_{1B}$. Similarly, assuming that the luminance and the gain values of R, G, and B from pixels displaying an image of the data 2(0) are represented by $L_{2R}$, $L_{2G}$, and $L_{2B}$ and $G_{2R}$, $G_{2G}$, and $G_{2B}$, respectively, the product of the data 2(0) and the gain value can be represented by $L_{2R}\times G_{2R}$, $L_{2G}\times G_{2G}$, and $L_{2B}\times G_{2B}$.

The calculation of product of the data 1(0) and a value corresponding to the gain value $G_1$ is performed for each of colors R, G, and B. For example, when the values corresponding to the gain values $G_1$ are any of values obtained by multiplying the gain values $G_{1R}$, $G_{1G}$, and $G_{1B}$ by respective arbitrary constants $C_{1R}$, $C_{1G}$, and $C_{1B}$, the products of the data 1(0) and the values corresponding to the gain value $G_1$ can be represented by $L_{1R}\times C_{1R}\times G_{1R}$, $L_{1G}\times C_{1G}\times G_{1G}$, and $L_{1B}\times C_{1B}\times G_{1B}$. Alternatively, when the values corresponding to the gain values $G_1$ are $G_{1R}^{C1R}$, $G_{1G}^{C1G}$, and $G_{1B}^{C1B}$, the products of the data 1(0) and the values corresponding to the gain values $G_1$ can be represented by $L_{1R}\times G_{1R}^{C1R}$, $L_{1G}\times G_{1G}^{C1G}$, and $L_{1B}\times G_{1B}^{C1B}$. Further alternatively, when the values corresponding to the gain values $G_1$ are $C_{1R}(1/G_{1R})$, $C_{1G}(1/G_{1G})$, and $C_{1B}(1/G_{1B})$, the products of the data 1(0) and the gain values $G_1$ can be represented by $L_{1R}\times C_{1R}(1/G_{1R})$, $L_{1G}\times C_{1G}(1/G_{1G})$, and $L_{1B}\times C_{1B}(1/G_{1B})$. The product of the data 2(0) and a value corresponding to the gain value $G_2$ can be calculated in the similar manner.

In other words, the value corresponding to the gain value $G_1$ and the value corresponding to the gain value $G_2$ can be defined as a function using the gain value $G_1$ as a variable and a function using the gain value $G_2$ as a variable, respectively. Each of the function using the gain value $G_1$ as a variable and the function using the gain value $G_2$ as a variable is not limited to a function of one variable, and may be defined as a function of two or more variables.

For simplicity, hereinafter, the gain value $G_1$ indicates any one of $G_{1R}$, $G_{1G}$, and $G_{1B}$, and the gain value $G_2$ indicates any one of $G_{2R}$, $G_{2G}$, and $G_{2B}$ in this specification. Thus, the product of the data 1(0) and $G_1$ indicates any of $L_{1R}\times G_{1R}$, $L_{1G}\times G_{1G}$, and $L_{1B}\times G_{1B}$, and the product of the data 2(0) and $G_2$ indicates any of $L_{2R}\times G_{2R}$, $L_{2G}\times G_{2G}$, and $L_{2B}\times G_{2B}$. This corresponds to the case where, in the calculation of the product of the data 1(0) and the value corresponding to the gain value $G_1$ ($C_{1R}\times G_{1R}$, $C_{1G}\times G_{1G}$, or $C_{1B}\times G_{1B}$), the constants $C_{1R}$, $C_{1G}$, and Cm are each 1. This also corresponds to the case where, in the calculation of the product of the data 2(0) and the gain value $G_2$ ($C_{2R}\times G_{2R}$, $C_{2G}\times G_{2G}$, or $C_{2B}\times G_{2B}$), the constants $C_{2R}$, $C_{2G}$, and $C_{2B}$, are each 1.

Each value of $G_1$ and $G_2$ is determined by the signal sparam transmitted to the gain calculation circuit 461. A specific determination method of each of $G_1$ and $G_2$ is described later.

The gain calculation circuit 461 outputs data 1(1) that is the product of the data 1(0) and the gain value $G_1$ or the value corresponding to the gain value $G_1$ and data 2(1) that is the product of the data 2(0) and the gain value $G_2$ or the value corresponding to the gain value $G_2$. Furthermore, the gain calculation circuit 461 transmits the data 1(1) and the data 2(1) to the data processing circuit 462. The data 1(1) and the data 2(1) are data obtained by performing dimming and toning on the data 1(0) and the data 2(0).

In addition, the gain calculation circuit 461 has a function of transmitting a signal drmd to the outside of the image processing portion 460. The signal drmd is a signal relating to an operation mode of the hybrid display device, which is transmitted mainly to a timing controller or the like. Specifically, the gain calculation circuit 461 has a function of selecting one operation mode of the hybrid display device from among first to third modes in accordance with the illuminance of external light measured with the optical sensor 443 and a function of transmitting the signal drmd including information of the selected operation mode to the outside of the image processing portion 460.

The data processing circuit 462 has a function of performing correction processing on the data 1(1) and the data 2(1) outputted from the gain calculation circuit 461 and a function of outputting the data 1(2) and the data 2(2). The correction processing performed in the data processing circuit 462 includes, for example EL correction processing, in addition to the gamma correction processing described above. The EL correction processing is performed on image data displayed using the display element (organic EL element) to adjust the luminance of the organic EL element.

Here, the input/output characteristics of image data that is inputted to the image processing portion 460 and image data that is processed in the image processing portion 460 and outputted from the image processing portion 460.

Figure 2:
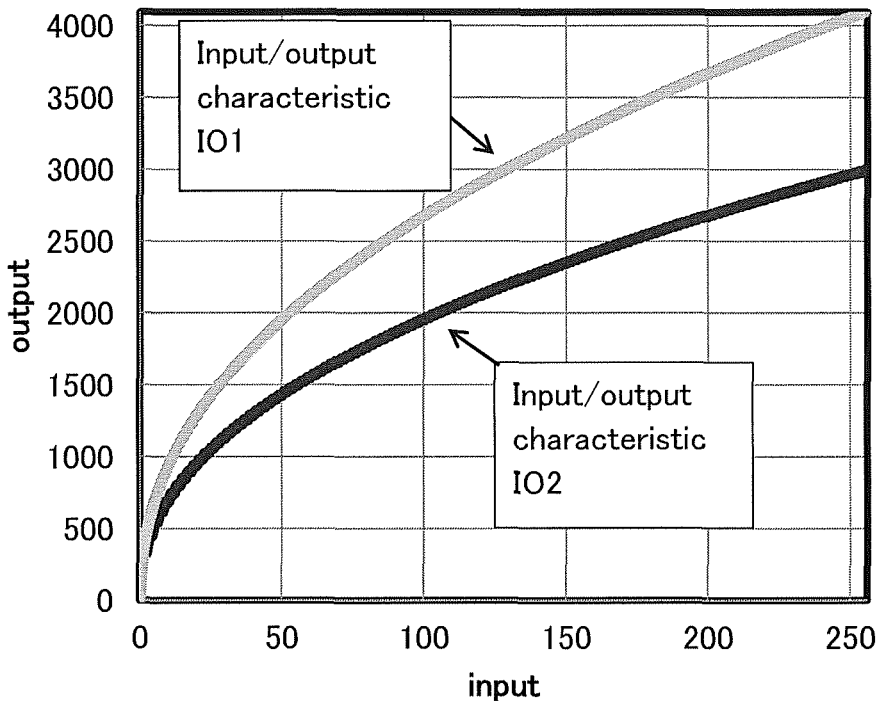
FIG. 2 is a graph showing input/output characteristics in an image processing portion.

FIG. 2 is an example of a graph of the input/output characteristics showing grayscale values of outputted image data with respect to grayscale values of inputted image data. In this example, the gain calculation circuit 461 in the image processing portion 460 outputs a value obtained by multiplying a gain value of 0.5 by the inputted image data. In addition, in this example, the data processing circuit 462 in the image processing portion 460 performs gamma correction, and a gamma value of the gamma correction is 2.2. Furthermore, in this example, the inputted image data is data with 8-bit grayscale and is converted into the outputted image data with 12-bit grayscale. Thus, the range of values on the horizontal axis is from 0 to 255, and the range of values on the vertical axis is from 0 to 4095. Note the graph shown in FIG. 2 is just an example, and another example in which the inputted image data has 8-bit grayscale and the outputted image data has 8-bit grayscale can be employed. In this case, the range of values on the horizontal axis is from 0 to 255, and the range of values on the vertical axis is from 0 to 255.

An input/output characteristic IO1 shows an input/output characteristic between grayscale values of image data inputted to the image processing portion 460 and grayscale values of image data outputted from the image processing portion 460. The outputted image data is data subjected to gamma correction processing and conversion from 8-bit to 12-bit in the data processing circuit 462. An input/output characteristic IO2 shows an input/output characteristic of grayscale values between image data inputted to the image processing portion 460 and grayscale values of image data outputted from the image processing portion 460. The outputted image data in this case is data subjected to arithmetic processing in the gain calculation circuit 461, and the gamma correction processing and conversion from 8-bit grayscale to 12-bit grayscale in the data processing circuit 462. In other words, the input/output characteristic IO2 shows characteristic obtained by adding the effect of dimming performed in the gain calculation circuit 461 to the input/output characteristic IO1.

When the grayscale value of inputted image data is 255 in the input/output characteristic IO2, the grayscale value of outputted image data is 2994 through the arithmetic processing in the gain calculation circuit 461, and the gamma correction and the data conversion from 8-bit grayscale to 12-bit grayscale in the data processing circuit 462. This grayscale value of the outputted image data is equivalent to the grayscale value of outputted image data in the input/ output characteristic IO1 when the grayscale value of inputted image data is 128. In other words, the grayscale value of the outputted image data in the input/output characteristic IO2 corresponds to the grayscale value of the outputted image data in the input/output characteristic IO1 when the grayscale value of the inputted data is multiplied by a gain value of 0.5.

As described above, the gain value is determined by the signal sparam transmitted from the optical sensor 443. In other words, the gain value fluctuates with a change in the brightness of the environment where the hybrid display device is used. In this case, instead of fixing the gain value in the input/output characteristic IO2 to 0.5, the gain value is made to fluctuate depending on the environment, so that the dimming can be dynamically performed on the inputted image data.

One embodiment of the present invention is not limited to the structure of the image processing portion 460 illustrated in FIG. 1A. Depending on circumstances or situations, the components in the image processing portion 460 can be selected as appropriate. Furthermore, depending on circumstances or situations, a connection structure in the image processing portion 460 can be changed.

For example, as a component of the image processing portion 460 in FIG. 1A, a frame memory may be included (not shown). When the frame memory is electrically connected to the gain calculation circuit 461 and the data processing circuit 462, data that is being processed in the gain calculation circuit 461 or the data processing circuit 462 can be stored temporarily. The frame memory may be provided outside the image processing portion 460 instead of being provided inside.

Figure 1B:
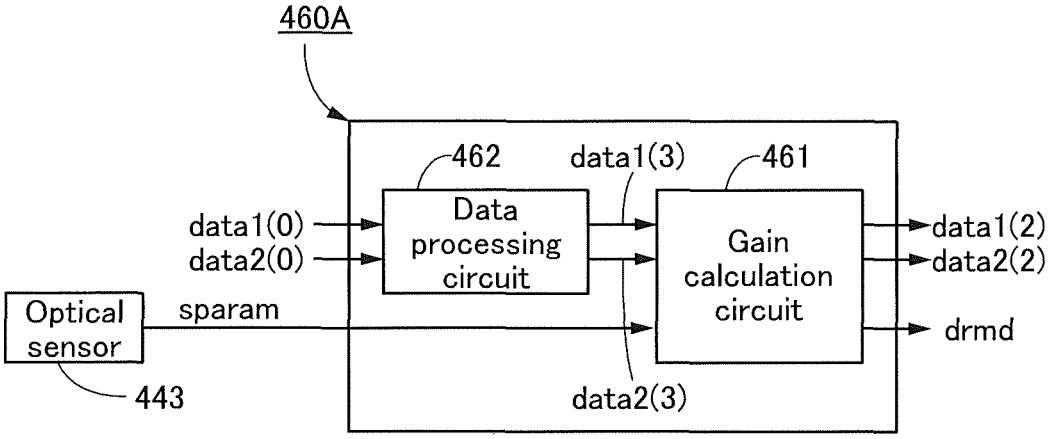

Alternatively, for example, a connection structure of the inside of the image processing portion 460 in FIG. 1A may be changed to that in an image processing portion 460A in FIG. 1B. In the image processing portion 460A, the data 1(0) and the data 2(0) transmitted from a host device or the like are inputted to the data processing circuit 462 before being inputted to the gain calculation circuit 461. Thus, in the image processing portion 460A, the correction processing is performed on the data 1(0) and the data 2(0) with the data processing circuit 462, the corrected data (denoted by data 1(3) and data 2(3) in FIG. 1B) are inputted to the gain calculation circuit 461, and the data 1(2) and the data 2(2) are outputted.

<Operation Example>

Next, an example of an operation method of a display device provided with the above-described image processing portion is described.

Figure 3:
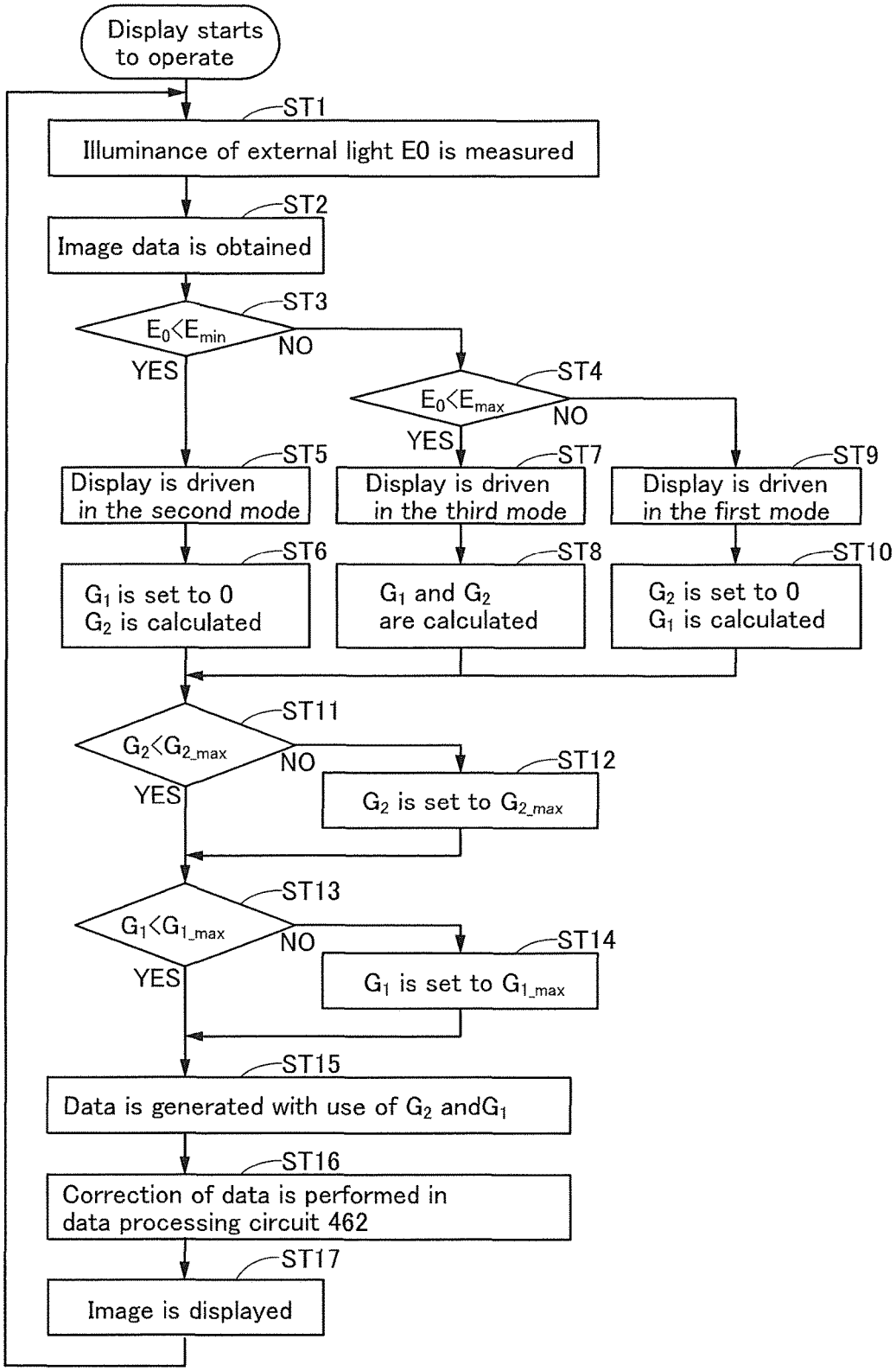
FIG. 3 is a flow chart showing an operation example of an image processing portion.

FIG. 3 is a flow chart showing an example of an operation method of the hybrid display device provided with the image processing portion 460. The operation method includes Step ST1 to Step ST17.

When the hybrid display device starts to operate, Step ST1 is carried out, first.

In Step ST1, an operation in which the illuminance of external light is measured with the optical sensor 443 is conducted. Note that in this specification, the measured illuminance is denoted by $E_0$. The measured illuminance $E_0$ is transmitted as the signal sparam to the gain calculation circuit 461.

In Step ST2, an operation in which image data is obtained from the outside of the image processing portion 460 (for example, from a host device or the like) is conducted. Specifically, the data 1(0) and the data 2(0) are inputted as image data to the gain calculation circuit 461.

In Step ST3, the determination of whether the illuminance $E_0$ is lower than illuminance $E_{min}$ is conducted. The illuminance $E_{min}$ is a parameter that is set in advance in the gain calculation circuit 461 and is used to select an operation mode of the hybrid display device from among the first to third modes. When the illuminance $E_0$ is lower than the illuminance $E_{min}$, the operation proceeds to Step ST5. When the illuminance $E_0$ is higher than or equal to the illuminance $E_{min}$, the operation proceeds to Step ST4.

In Step ST4, the determination of whether the illuminance $E_0$ is lower than illuminance $E_{max}$ is conducted. The illuminance $E_{max}$ is a parameter that is set in advance in the gain calculation circuit 461, like the illuminance $E_{min}$, and is used to select an operation mode of the hybrid display device from among the first to third modes. When the illuminance $E_0$ is lower than the illuminance $E_{max}$, the operation proceeds to Step ST7. When the illuminance $E_0$ is higher than or equal to the illuminance $E_{max}$, the operation proceeds to Step ST9.

In Step ST5, an operation in which a control signal for driving the hybrid display device in the second mode is transmitted as the signal drmd from the gain calculation circuit 461 to the outside of the image processing portion 460 is conducted. Thus, the hybrid display device is driven in the second mode. The second mode is a mode for displaying an image only with a light-emitting element that is the second display element. Thus, the driving in the second mode is suitable for the hybrid display device in the environment where the illuminance $E_0$ of external light is lower than the illuminance $E_{min}$ (in a dark environment). Furthermore, in the hybrid display device driving in the second mode, the driving of the first display element can be stopped. In this case, the driving of the first display element can be controlled with the signal drmd.

In Step ST6, the gain values $G_1$ and $G_2$ are set. $G_1$ is a gain value used when an image is displayed using the first display element. Since the hybrid display device is driven in the second mode (only using the second display element) in Step ST5, $G_1$ is set to 0. $G_2$ is a gain value used when an image is displayed using the second display element, and can be calculated by the following linear function, for example.

[Formula 1]

$$G_2 = a_{2(2)} \times E_0 + b_{2(2)} \tag{E1}$$

In the above formula, $a_{2(2)}$ and $b_{2(2)}$ are each a parameter set in advance in the gain calculation circuit 461.

In Step ST7, an operation in which a control signal for driving the hybrid display device in the third mode is transmitted as the signal drmd from the gain calculation circuit 461 to the outside of the image processing portion 460 is conducted. Thus, the hybrid display device is driven in the third mode. The third mode is a mode in which an image is displayed with use of a reflective element (first display element) and the light-emitting element (second display element). Accordingly, in an environment where the illuminance $E_0$ of external light is higher than or equal to the illuminance $E_{min}$ and lower than the illuminance $E_{max}$, the driving in the third mode is suitable for the hybrid display device.

In Step ST8, the gain values $G_1$ and $G_2$ are set. $G_1$ is a gain value used when an image is displayed using the first display element and can be calculated by the following linear function, for example.

[Formula 2]

$$G_1=a_{1(3)}\times E_0+b_{1(3)} \quad \text{(E2)}$$

In the formula, $a_{1(3)}$ and $b_{1(3)}$ are each a parameter set in advance in the gain calculation circuit 461.

$G_2$ is a gain value used when an image is displayed using the second display element, and can be calculated by the following linear function, for example.

[Formula 3]

$$G_2=a_{2(3)}\times E_0+b_{2(3)} \quad \text{(E3)}$$

In the formula, $a_{2(3)}$ and $b_{2(3)}$ are each a parameter set in advance in the gain calculation circuit 461.

In Step ST9, an operation in which a control signal for driving the hybrid display device in a first mode is transmitted as the signal drmd from the gain calculation circuit 461 to the outside of the image processing portion 460 is conducted. Thus, the hybrid display device is driven in the first mode. The first mode is a mode in which an image is displayed only using the reflective element (first display element). Accordingly, in an environment where the illuminance $E_0$ of external light is higher than or equal to the illuminance $E_{max}$ (bright environment), the driving in the first mode is suitable for the hybrid display device. Furthermore, the driving of the second display element can be stopped when the hybrid display device is driven in the first mode. In this case, the driving of the second display element can be controlled with the signal drmd.

In Step ST10, the gain values $G_1$ and $G_2$ are set. $G_2$ is a gain value used when an image is displayed using the second display element. Since the hybrid display device is driven in the first mode (only using the first display element) in Step ST9, $G_2$ is set to 0. $G_1$ is a gain value used when an image is displayed using the first display element and can be calculated by the following linear function, for example.

[Formula 4]

$$G_1=a_{1(1)}\times E_0+b_{1(1)} \quad \text{(E4)}$$

In the formula, $a_{1(1)}$ and $b_{1(1)}$ are each a parameter set in advance in the gain calculation circuit 461.

The formula for determining $G_2$ in Step ST6, the formulae for determining $G_1$ and $G_2$ in Step ST8, and the formula for determining $G_1$ in Step ST10 are not limited to the above formulae, and for example, a higher-degree function, an exponential function, or the like may be used.

In Step ST11, the determination of whether $G_2$ determined in either Step ST6 or Step ST8 is lower than $G_{2_max}$ is conducted. $G_{2_max}$ is a parameter set in advance in the gain calculation circuit 461 and is defined as the maximum value in a range of values the gain value $G_2$ can have. When $G_2$ is lower than $G_{2_max}$, the operation proceeds to Step ST13, and when $G_2$ is higher than or equal to $G_{2_max}$, the operation proceeds to Step ST12.

In Step ST12, an operation in which $G_2$ is changed to $G_{2_max}$ is conducted. Step ST12 is an operation conducted when $G_2$ determined in Step ST6 or Step ST8 is higher than or equal to $G_{2_max}$. When $G_2$ is higher than or equal to $G_{2_max}$ that is the maximum value in the range of values the gain value $G_2$ can have, $G_2$ is used as $G_{2_max}$.

In Step ST13, the determination of whether $G_1$ determined in either Step ST8 or Step ST10 is lower than $G_{1_max}$ is conducted. $G_{1_max}$ is a parameter set in advance in the gain calculation circuit 461 and is defined as the maximum value in a range of values the gain value $G_1$ can have. When $G_1$ is lower than $G_{1_max}$, the operation proceeds to Step ST15, and when $G_1$ is higher than or equal to $G_{1_max}$, the operation proceeds to Step ST14.

In Step ST14, an operation in which $G_1$ is changed to $G_{1_max}$ is conducted. Step ST14 is an operation conducted when $G_1$ determined in Step ST8 or Step ST10 is higher than or equal to $G_{1_max}$. When $G_1$ is higher than or equal to $G_{1_max}$ that is the maximum value in the range of values the gain value $G_1$ can have, $G_1$ is used as $G_{1_max}$.

In Step ST15, an operation in which the data 1(1) and the data 2(1) are generated with use of the gain values $G_1$ and $G_2$ determined through the operations in Step ST1 to Step ST14 and the data 1(0) and the data 2(0) inputted to the image processing portion 460 is conducted.

In Step ST16, the data 1(1) and the data 2(1) generated in Step ST15 is transmitted to the data processing circuit 462 to be subjected to predetermined correction processing. The data 1(1) and the data 2(1) subjected to the correct processing are outputted as the data 1(2) and the data 2(2) to the outside of the image processing portion 460.

In Step ST17, the data 1(2) and the data 2(2) are transmitted to the first display element and the second display element, respectively, to display images of the data 1(2) and the data 2(2) on the hybrid display device. After Step ST17 is completed, the operation returns to Step ST1, and the process are repeated.

In this specification and the like, the whole operation method is divided into a plurality of operations, and each operation is shown as an independent step in the flow chart. However, it is difficult to divide the operation method into a plurality of operations actually, and there may occur a case where a plurality of operations are included in one step, or a case where one operation is conducted through a plurality of steps. Thus, the steps shown in the flow chart are not limited to the operations described in this specification and the order of the steps can be changed as appropriate according to circumstances.

For example, in the flow chart shown in FIG. 3, the operations of Step ST5 and Step ST6 can be interchanged with each other. In other words, after the gain values $G_1$ and $G_2$ are determined, the signal drmd for driving the hybrid display device may be transmitted. In addition, the operations of Step ST7 and Step ST8 can be interchanged with each other, and the operations of Step ST9 and Step ST10 can be interchanged with each other.

<Change in Gain Values $G_1$ and $G_2$ with Respect to Illuminance $E_0$ of External Light>

Changes in the gain values $G_1$ and $G_2$ with respect to the illuminance $E_0$ of external light in the above operation example are described.

Figure 4A:
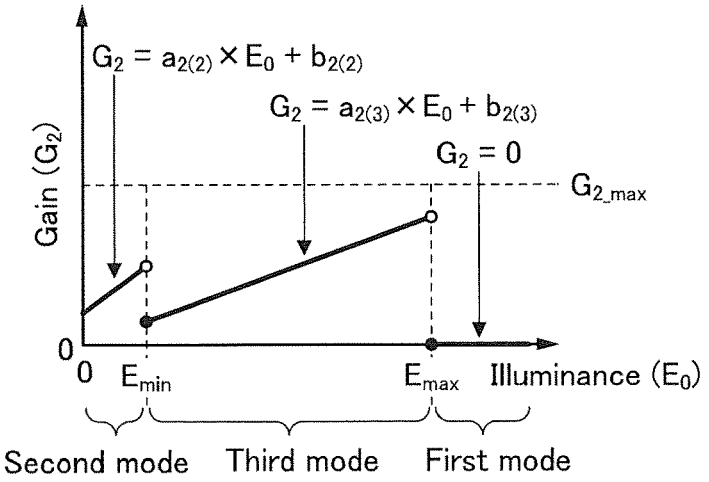
FIGS. 4A to 4C are each a graph showing a change in a gain value with respect to an illuminance of external light.
Figure 4B:
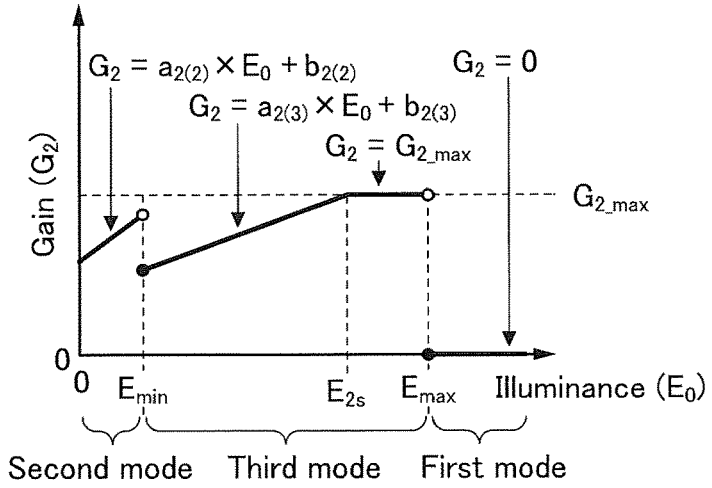

FIGS. 4A and 4B are graphs each showing a change in the gain value $G_2$ with respect to the illuminance $E_0$, where the horizontal axis represents the illuminance $E_0$ and the vertical axis represents the gain value $G_2$.

The graph in FIG. 4A shows the case where the gain value $G_2$ does not reach the $G_{2_max}$ at any level of the illuminance $E_0$. When the illuminance $E_D$ of external light is lower than $E_{min}$, $G_2$ is a value that satisfies Formula (E1). When the illuminance $E_0$ of external light is higher than or equal to $E_{min}$ and lower than $E_{max}$, $G_2$ is a value that satisfies Formula (E3). When the illuminance $E_0$ of external light is higher than or equal to $E_{max}$, $G_2$ is 0.

The graph in FIG. 4B shows the case where the gain value $G_2$ becomes $G_{2_max}$ according to Formula (E3) when the illuminance $E_0$ of external light is $E_{2s}$ ($E_{2s}$ is the illuminance higher than or equal to $E_{min}$ and lower than $E_{max}$). When the illuminance $E_0$ of external light is lower than $E_{min}$, $G_2$ is a value satisfying Formula (E1). When the illuminance $E_0$ of external light is higher than or equal to $E_{min}$ and lower than $E_{2s}$, $G_2$ is a value satisfying Formula (E3). When the illuminance $E_0$ of external light is higher than or equal to $E_{2s}$ and lower than $E_{max}$, $G_2$ becomes $G_{2_max}$. When the illuminance $E_0$ of external light is higher than or equal to $E_{max}$, $G_2$ is 0.

Figure 4C:
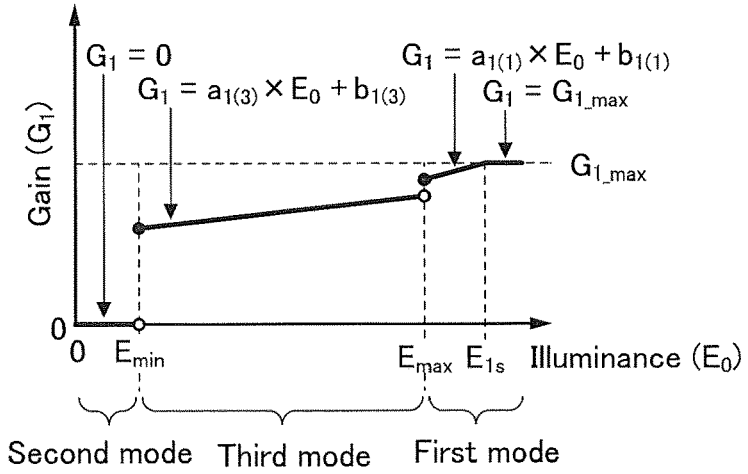

FIG. 4C is a graph showing a change in the gain value $G_1$ with respect to the illuminance $E_0$, where the horizontal axis represents the illuminance $E_0$ and the vertical axis represents the gain value $G_1$.

The graph in FIG. 4C shows the case where the gain value $G_1$ becomes $G_{1_max}$ according to Formula (E4) when the illuminance $E_0$ of external light is $E_{1s}$ ($E_{1s}$ is the illuminance higher than $E_{max}$). When the illuminance $E_0$ of external light is lower than $E_{min}$, $G_1$ is 0. When the illuminance $E_0$ of external light is higher than or equal to $E_{min}$ and lower than $E_{max}$, $G_1$ is a value satisfying Formula (E2). When the illuminance $E_0$ of external light is higher than or equal to $E_{max}$ and lower than $E_{1s}$, $G_1$ is a value satisfying Formula (E4). When the illuminance $E_0$ of external light is higher than or equal to $E_{1s}$, $G_1$ becomes $G_{1_max}$.

FIG. 4C shows the case where the gain value $G_1$ becomes $G_{1_max}$ according to Formula (E4) when the illuminance $E_0$ of external light is $E_{1s}$. However, the operation of the gain calculation circuit 461 is not limited to this case. For example, there is a conceivable case where the gain value $G_1$ reaches $G_{1_max}$ according to Formula (E2) when the illuminance $E_0$ of external light is higher than or equal to $E_{min}$ and lower than $E_{max}$. In this case, $G_1$ is $G_{1_max}$ at the illuminance higher than that of external light at which $G_1$ becomes $G_{1_max}$ according to Formula (E2).

In FIGS. 4A to 4C, the parameters $a_{1(1)}$, $a_{2(2)}$, $a_{1(3)}$, and $a_{2(3)}$ used in Formula (E1) to Formula (E4) are values greater than 0. However, the operation of the gain calculation circuit 461 is not limited to this case. For example, at least one of $a_{1(1)}$, $a_{2(2)}$, $a_{1(3)}$, and $a_{2(3)}$ may be a value less than 0. Alternatively, for example, at least one of $a_{1(1)}$, $a_{2(2)}$, $a_{1(3)}$, and $a_{2(3)}$ may be 0.

Figure 5A:
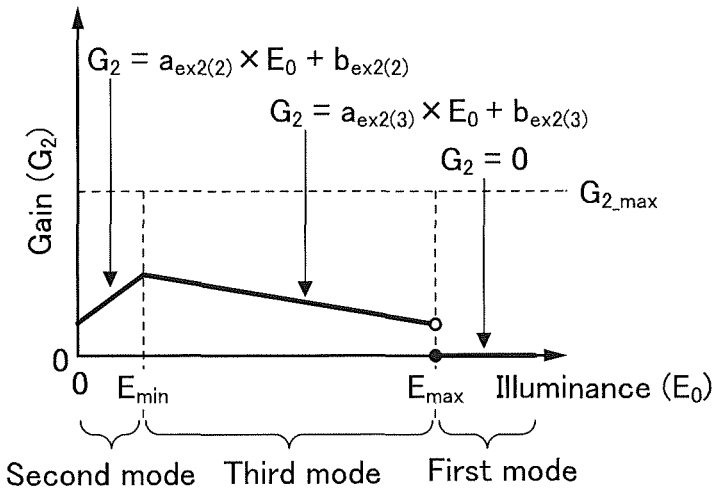
FIGS. 5A and 5B are each a graph showing a change in a gain value with respect to an illuminance of external light.
Figure 5B:
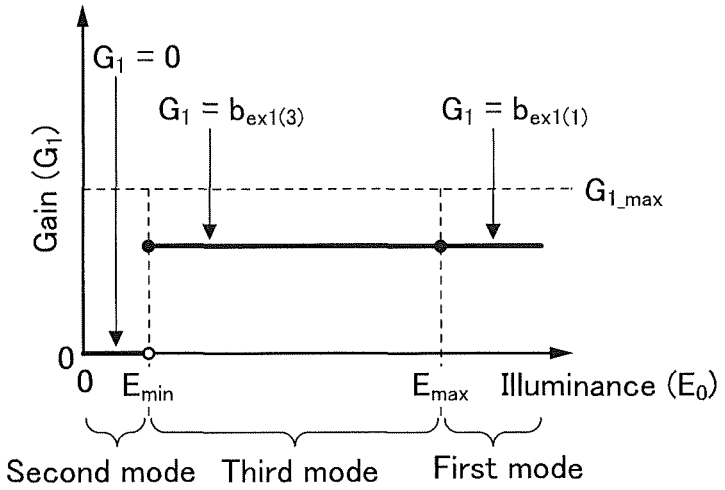

FIG. 5A is a graph showing a change in the gain value $G_2$ with respect to the illuminance $E_0$ in the case where $a_{2(3)}$ is less than 0. FIG. 5B is a graph showing the gain value $G_1$ with respect to the illuminance $E_0$ in the case where $a_{1m}$ and $a_{1(3)}$ are 0.

The graph in FIG. 5A shows the case where the gain value $G_2$ does not reach $G_{2_max}$ at any level of the illuminance $E_0$. When the illuminance $E_0$ of external light is lower than $E_{min}$, $G_2$ is a value satisfying Formula (E1). Here, a value of $a_{2(2)}$ is $a_{ex2(2)}$ that is a value greater than 0, and a value of $b_{2(2)}$ is $b_{ex2(2)}$ that is a value greater than 0. When the illuminance $E_0$ of external light is higher than or equal to $E_{min}$ and lower than $E_{max}$, $G_2$ is a value satisfying Formula (E3). Here, a value of $a_{2(3)}$ is $a_{ex2(3)}$ that is a value less than 0, and a value of $b_{2(3)}$ is $b_{ex2(3)}$ that is a value greater than 0. When the illuminance $E_0$ of external light is higher than or equal to $E_{max}$, $G_2$ is 0.

The graph in FIG. 5B shows the case where the gain value $G_1$ has a constant value when the illuminance $E_0$ of external light is higher than or equal to $E_{min}$. When the illuminance $E_0$ of external light is lower than $E_{min}$, $G_1$ is 0. When the illuminance $E_0$ of external light is higher than or equal to $E_{min}$ and lower than $E_{max}$, $G_1$ is a value satisfying Formula (E2) where a value of $a_{1(3)}$ is 0 and a value of $b_{1(3)}$ is $b_{ex1(3)}$ that is a value greater than 0. When the illuminance $E_0$ of external light is higher than or equal to $E_{max}$, $G_1$ is a value satisfying Formula (E4) where a value of $a_{1(1)}$ is 0 and a value of $b_{1(1)}$ is $b_{ex1(1)}$ that is a value equivalent to $b_{ex3(1)}$. Furthermore, in this case, $b_{ex1(1)}$ and $b_{ex1(3)}$ may be $G_{1_max}$.

In such a manner, the gain values $G_1$ and $G_2$ are determined in the gain calculation circuit 461, whereby the data 1(1) and the data 2(1), which are the products of the gain values $G_1$ and $G_2$ and the data 1(0) and the data 2(0) inputted to the image processing portion 460, can be outputted. Thus, dimming can be performed on the data 1(0) and the data 2(0). Furthermore, arithmetic operation specific to each color of R, G, and B is performed, whereby toning can be performed.

Note that the parameters $E_{min}$, $E_{max}$, $a_{1(1)}$, $b_{1(1)}$, $a_{2(2)}$, $b_{2(2)}$, $a_{1(3)}$, $b_{1(3)}$, $a_{2(3)}$, $b_{2(3)}$, $G_{1_max}$, and $G_{2_max}$ used in this embodiment may be predetermined in advance in formation of the gain calculation circuit 461 or set freely by a user seeing a displayed image.

Note that this embodiment can be combined with any of the other embodiments in this specification as appropriate.

Embodiment 2

In this embodiment, a structure of an electronic device including a hybrid display device and its peripheral device will be described. Note that the hybrid display device includes the image processing portion 460 described in Embodiment 1.

<Configuration Example>

Figure 6:
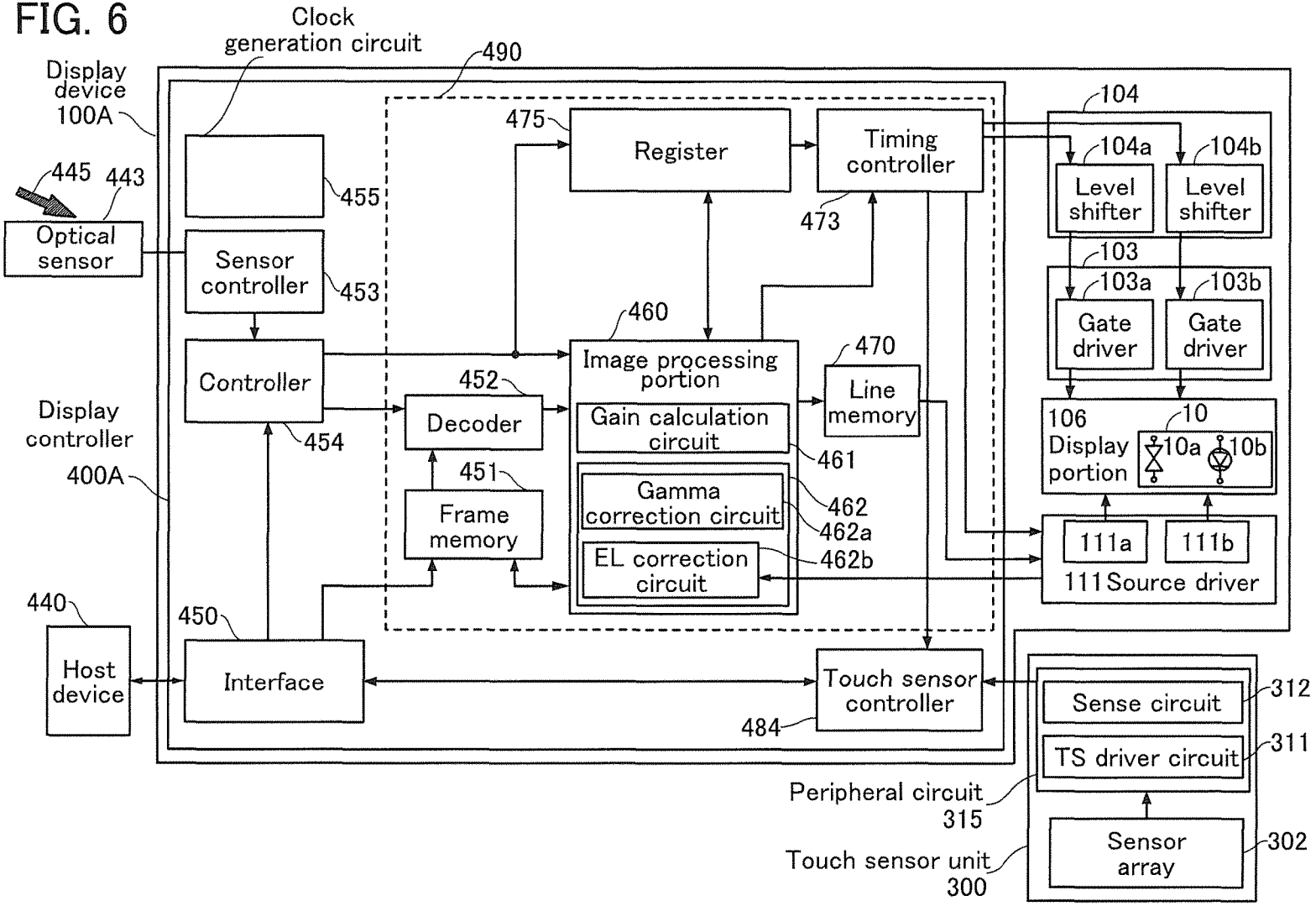
FIG. 6 is a block diagram illustrating a configuration example of an electronic device.

FIG. 6 is a block diagram illustrating a display device and its peripheral device, which shows a configuration example of an electronic device.

A display device 100A includes a display controller 400A, a gate driver 103, a level shifter 104, a display portion 106, and a source driver 111. A host device 440, a touch sensor unit 300, and the optical sensor 443 each function as a peripheral device of the display device 100A and are electrically connected to the display device 100A.

In some cases, the display controller 400A, the gate driver 103, the level shifter 104, and the source driver 111 can be mounted as one integrated circuit (IC) or different ICs over a substrate where the display portion 106 is formed by a chip on glass (COG) method or the like. Instead of using a COG method, there is also a case where the above IC(s) can be mounted over a flexible print circuit (FPC) that is electrically connected to the substrate by a chip on film (COF) method or the like. All of the display controller 400A, the gate driver 103, the level shifter 104, and the source driver 111 are not necessarily fabricated as an IC/ICs, and there is a case where some components can be formed directly over the substrate depending on the circuit configuration.

The display controller 400A includes an interface 450, a frame memory 451, a decoder 452, a sensor controller 453, a controller 454, a clock generation circuit 455, the image processing portion 460, a line memory 470, a timing controller 473, a register 475, and a touch sensor controller 484. In this specification, the frame memory 451, the decoder 452, the image processing portion 460, the line memory 470, the timing controller 473, and the register 475 are collectively referred to as a region 490.

The touch sensor unit 300 includes a sensor array 302, a touch sensor (TS) driver circuit 311, and a sense circuit 312. In this specification, the TS driver circuit 311 and the sense circuit 312 are collectively referred to as a peripheral circuit 315.

The display portion 106 includes a pixel 10, and the pixel 10 includes a reflective element 10*a* and a light-emitting element 10*b*. The reflective element 10*a* corresponds to the first display element described in the other embodiment, and the light-emitting element 10*b* corresponds to the second display element described in Embodiment 1.

The gate driver 103 includes a gate driver 103*a* and a gate driver 103*b*. The gate driver 103*a* has a function of selecting the reflective element 10*a* in the display portion 106, and the gate driver 103*b* has a function of selecting the light-emitting element 10*b* in the display portion 106.

The level shifter 104 includes a level shifter 104*a* and a level shifter 104*b*. The level shifter 104*a* is electrically connected to the gate driver 103*a*. In addition, the level shifter 104*a* is electrically connected to the timing controller 473. The level shifter 104*a* has a function of shifting a level of a timing signal transmitted from the timing controller 473 to an appropriate level and transmitting the level-shifted timing signal to the gate driver 103*a*. The level shifter 104*b* is electrically connected to the gate driver 103*b*. Furthermore, the level shifter 104*b* is electrically connected to the timing controller 473. The level shifter 104*b* has a function of shifting a level of a timing signal transmitted from the timing controller 473 to an appropriate level and transmitting the level-shifted timing signal to the gate driver 103*b*.

The source driver 111 includes a source driver 111*a* and a source driver 111*b*. The source driver 111*a* has a function of transmitting image data from the line memory 470 to the reflective element 10*a* in the display portion 106, and the source driver 111*b* has a function of transmitting image data from the line memory 470 to the light-emitting element 10*b* in the display portion 106.

The host device 440 is electrically connected to the interface 450, the touch sensor controller 484 is electrically connected to the peripheral circuit 315 in the touch sensor unit 300, and the optical sensor 443 is electrically connected to the sensor controller 453.

Communication between the display controller 400A and the host device 440 is performed through the interface 450. Specifically, the host device 440 transmits image data, various control signals, and the like to the display controller 400A through the interface 450. The display controller 400A transmits information such as a touch position obtained by the touch sensor controller 484 to the host device 440. Note that circuits that are to be provided in the display controller 400A are determined as appropriate, depending on the standard of the host device 440, the specifications of the display device 100A, or the like.

The host device 440 will be described in detail in Embodiment 3.

The frame memory 451 is a memory for storing the image data inputted to the display controller 400A. In the case where compressed image data is transmitted from the host device, the frame memory 451 can store the compressed image data. The decoder 452 is a circuit for decompressing the compressed image data. When decompression of the image data is not needed, processing is not performed on the decoder 452. Alternatively, the decoder 452 can be provided between the frame memory 451 and the interface 450.

The frame memory 451 may be used for temporarily storing image data that is being processed in the image processing portion 460. In this case, communication of data may be conducted directly between the frame memory 451 and the image processing portion 460 without through the decoder 452.

As the image processing portion 460, the image processing portion 460 described in Embodiment1 can be used. In this case, the image processing portion 460 includes the gain calculation circuit 461 and the data processing circuit 462. The data processing circuit 462 has a function of performing various kinds of image processing on image data. For example, the data processing circuit 462 includes a gamma correction circuit 462*a* and an EL correction circuit 462*b*.

The image data processed in the image processing portion 460, for example, the data 1(2) and the data 2(2), is outputted to the source driver 111 through the line memory 470. The line memory 470 is a memory for temporarily storing image data and is called a line buffer in some cases. The source driver 111 has a function of processing the inputted image data and writing the image data to a source line of the display portion 106.

The timing controller 473 has a function of generating timing signals to be used in the source driver 111, the touch sensor controller 484, and the gate driver 103. In this configuration example, the level of a timing signal inputted to the gate driver 103 is shifted by the level shifter 104, and then the signal is transmitted to the gate driver 103. The gate driver 103 has a function of selecting a pixel in the display portion 106.

The touch sensor controller 484 has a function of controlling the TS driver circuit 311 and the sense circuit 312. A signal including touch information read from the sense circuit 312 is processed in the touch sensor controller 484 and transmitted to the host device 440 through the interface 450. The host device 440 generates image data reflecting the touch information and transmits the image data to the display controller 400A. Note that in the display controller 400A, the touch information can be reflected to the image data.

The clock generation circuit 455 has a function of generating a clock signal to be used in the display controller 400A. The controller 454 has a function of processing a variety of control signals transmitted from the host device 440 through the interface 450 and controlling a variety of circuits in the display controller 400A. The controller 454 also has a function of controlling power supply to the variety of circuits in the display controller 400A. Hereinafter, temporary stop of power supply to a circuit that is not used is referred to as power gating. The power gating will be described later.

In particular, when the display portion 106 includes the OS transistor, image data can be stored in a display element for a long time because the off-state current of the OS transistor is extremely low. In other words, refresh operation of the image data is not necessarily performed in displaying a still image, and thus power gating can be performed on a predetermined circuit in the display device 100A. In this specification, such operation is referred to as idling stop (also referred to as IDS in this specification) driving. The IDS driving will be described in detail in Embodiment 4.

The register 475 stores data used for the operation of the display controller 400A. The data stored in the register 475 includes a parameter used to perform correction processing in the image processing portion 460, parameters used to generate waveforms of a variety of timing signals in the timing controller 473, and the like.

The register 475 is provided with a scan chain register including a plurality of registers. The sensor controller 453 is electrically connected to the optical sensor 443. The optical sensor 443 senses illuminance of each of R, G, and B included in external light 445 and generates sensor signals. The sensor controller 453 generates a control signal on the basis of the sensor signal. The control signal generated in the sensor controller 453 is outputted to the controller 454, for example.

An acceleration sensor may be electrically connected to the sensor controller 453. The acceleration sensor that is electrically connected to the display device 100A enables the display device 100A to conduct an operation such as a change of an image displayed on the display portion 106 in accordance with the inclination of the display device 100A. Furthermore, a thermal sensor may be electrically connected to the sensor controller 453. The thermal sensor that is electrically connected to the display device 100A enables the display device 100A to conduct an operation such as a change of an image displayed on the display portion 106 in accordance with the temperature of the display device 100A. In such a case, under a condition of relatively high temperature of the display device 100A, it is effective to perform image processing in the image processing portion 460 or the like so that the luminance of the second display element decreases.

Furthermore, in the case where the display device 100A is incorporated in a folding electronic device, an open/close sensor may be electrically connected to the sensor controller 453. Such a configuration enables the following operation: the driving of the display device 100A can be stopped when the electronic device is folded, and the driving of the display device 100A can be started when the electronic device is opened.

<<Power Gating>>

In the case where image data transmitted from the host device 440 is not changed, the controller 454 can conduct power gating on some circuits in the display controller 400A. Specifically, the some circuits indicate the circuits in the region 490, for example. Power gating can be performed in the case where a control signal that indicates no change in the image data is transmitted from the host device 440 to the display controller 400A and detected by the controller 454.

The circuits subjected to power gating are not limited to the circuits in the display controller 400A. For example, the power gating may be performed on the source driver 111, the level shifter 104, the gate driver 103, and the like.

The circuits in the region 490 are the circuits relating to image data and the circuits for driving the display device 100A; therefore, the circuits in the region 490 can be temporarily stopped in the case where the image data is not changed. Note that even in the case where the image data is not changed, a time during which a transistor used for a pixel in the display portion 106 can store data (time for IDS) may be considered. Furthermore, in the case where a liquid crystal element is used as a reflective element in the pixel in the display portion 106, a time for inversion driving performed to prevent burn-in of the liquid crystal element may be considered.

For example, the controller 454 may be incorporated with a timer function so as to determine timing at which power supply to the circuits in the region 490 is restarted, on the basis of time measured by a timer. Note that it is possible to store image data in the frame memory 451 or the line memory 470 in advance and supply the image data to the display portion 106 at inversion driving. With such a structure, inversion driving can be performed without transmitting the image data from the host device 440. Thus, the amount of data transmitted from the host device 440 can be reduced and power consumption of the display controller 400A can be reduced.

The configuration of the display device 100A or the display controller 400A is not limited to the configuration example described in this embodiment. A variety of combinations can be considered depending on the specifications of the display controller 400A, the standard of the host device 440, the specifications of the display device 100A, and the like.

Figure 7:
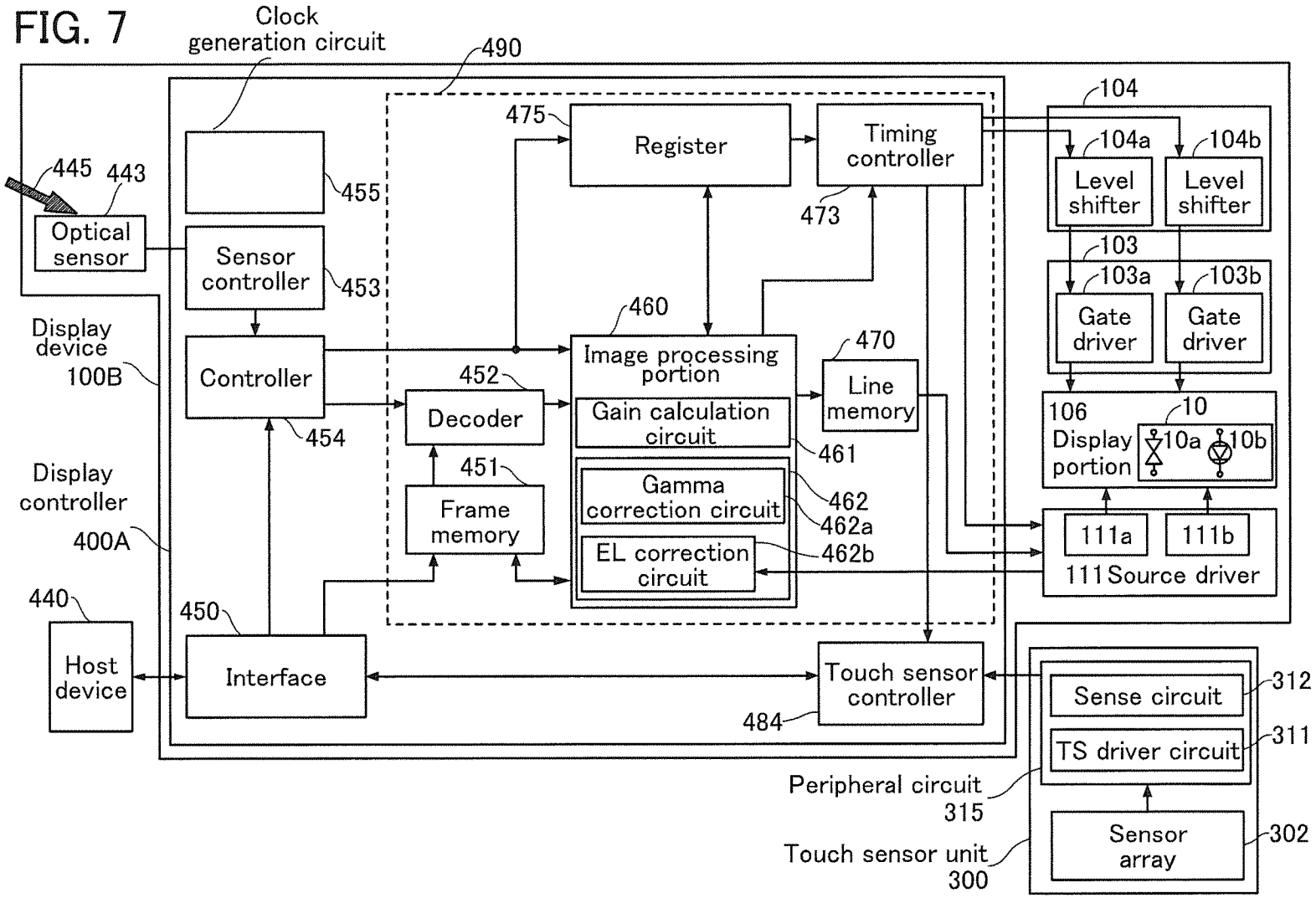
FIG. 7 is a block diagram illustrating a configuration example of an electronic device.
Figure 8:
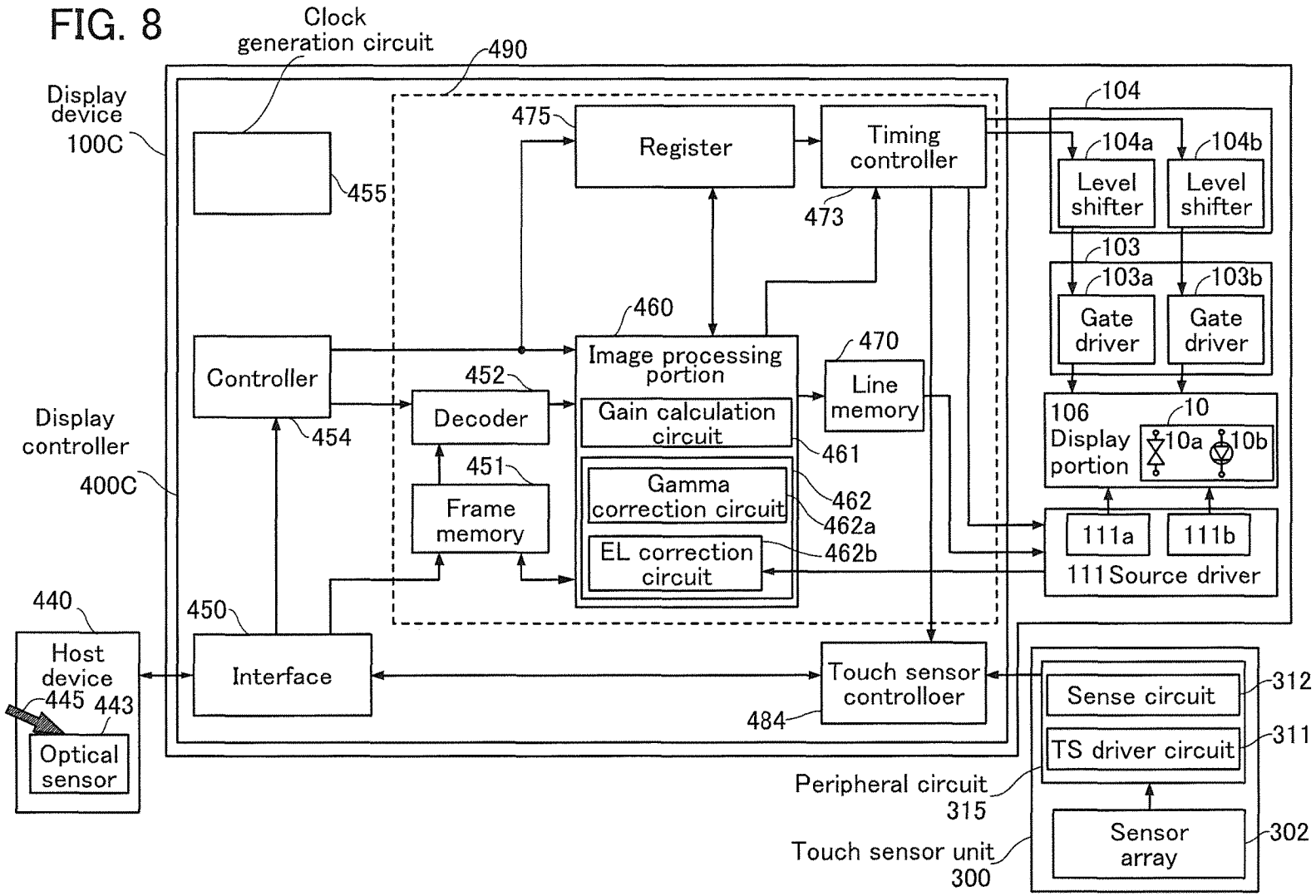
FIG. 8 is a block diagram illustrating a configuration example of an electronic device.

For example, although the optical sensor 443 is described as the peripheral device of the display device 100A in this embodiment, the optical sensor 443 may be included in a display device 100B as illustrated in FIG. 7. Furthermore, as illustrated in FIG. 8, for example, the optical sensor 443 may be included in the host device 440, and neither a display device 100C nor a display controller 400C may include the optical sensor 443 and the sensor controller 453.

Note that this embodiment can be combined with any of the other embodiments in this specification as appropriate.

Embodiment 3

In this embodiment, a specific structure example of the host device 440 described in the above embodiment will be described.

Figure 9:
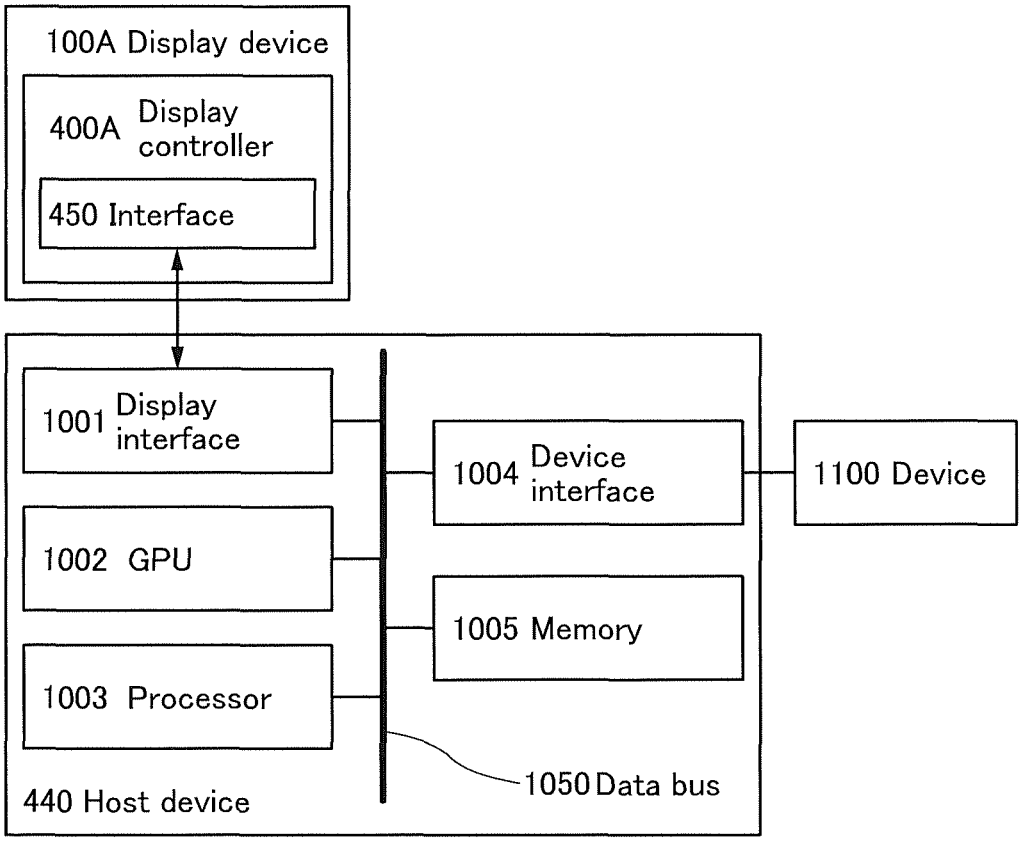
FIG. 9 is a block diagram illustrating a configuration example of a host device.

FIG. 9 is a block diagram illustrating a configuration example of the host device 440. In FIG. 9, the display device 100A and a device 1100 which are electrically connected to the host device 440 are also illustrated.

The host device 440 includes a display interface 1001, a graphics processing unit (GPU) 1002, a processor 1003, a device interface 1004, a memory 1005, and a data bus 1050.

The display interface 1001, the GPU 1002, the processor 1003, the device interface 1004, and the memory 1005 are electrically connected to each other with the data bus 1050.

The display interface 1001 is electrically connected to the interface 450 included in the display controller 400A. The display interface 1001 is a device which performs communication between the display controller 400A and the host device 440 and control thereof.

The GPU 1002 is a device that processes image data transmitted to the display device 100A. In particular, the GPU 1002 can conduct calculation needed to display 3D images, and thus the amount of processing by the processor 1003 can be reduced.

The processor 1003 functions as an arithmetic device or a control device and controls the entire operation of devices in the host device 440. For the processor 1003, a central processing unit (CPU) or a microprocessor unit (MPU) can be used.

The device interface 1004 performs communication between the host device 440 and the device 1100 corresponding to an external device and control thereof. Examples of the device 1100 include a keyboard, a mouse, an external storage device, a microphone, and a speaker.

The memory 1005 stores data. In the case where data is stored temporarily, a volatile memory such as a dynamic random access memory (DRAM) or a static random access memory (SRAM) can be used. In the case where the data is stored constantly, a nonvolatile memory such as a flash memory, a magnetic memory device (hard disk drive, a magnetic memory, or the like), or a read only memory (ROM) can be used. Furthermore, both the volatile memory and the nonvolatile memory can be used.

Note that this embodiment is effective not only in the display device 100A but also in the display devices 100B and 100C.

Note that the configuration of the host device 440 described in this embodiment is just an example. Depending on circumstances or conditions or as needed, the components can be selected as appropriate. For example, a plurality of device interfaces may be provided, unlike the case of only one device interface as illustrated in FIG. 9. Furthermore, in the case where the image processing with a high load is not performed, a configuration without the GPU 1002 may be employed.

This embodiment can be combined with any of the other embodiments in this specification as appropriate.

Embodiment 4

In this embodiment, a hybrid display device which can be used for the display device of the electronic device described in Embodiment 2 will be described with reference to FIGS. 10A to 10D, FIGS. 11A to 11D, FIG. 12, FIG. 13, and FIGS. 14A to 14D.

The display device of this embodiment includes a first display element reflecting visible light and a second display element emitting visible light. The display device has a function of displaying an image using one or both of light reflected by the first display element and light emitted from the second display element.

As the first display element, an element which displays an image by reflecting external light can be used. Such an element does not include a light source; thus, power consumed in displaying an image can be significantly reduced.

As the first display element, a reflective liquid crystal element can be typically used. As the first display element, other than a micro electro mechanical systems (MEMS) shutter element or an optical interference type MEMS element, an element using a microcapsule method, an electrophoretic method, an electrowetting method, or the like can also be used.

As the second display element, a light-emitting element is preferably used. Since the luminance and the chromaticity of light emitted from such a display element are hardly affected by external light, a clear image that has high color reproducibility (wide color gamut) and a high contrast can be displayed.

As the second display element, a self-luminous light-emitting element such as an organic light-emitting diode (OLED), a light-emitting diode (LED), an inorganic EL element, a quantum-dot light-emitting diode (QLED), and a semiconductor laser (e.g., a nitride semiconductor light-emitting diode) can be used. Note that it is preferable to use a self-luminous light-emitting element as the second display element; however, the second display element is not limited thereto and may be a transmissive liquid crystal element combining a light source, such as a backlight or a sidelight, and a liquid crystal element, for example.

The display device of this embodiment has a first mode in which an image is displayed using the first display element, a second mode in which an image is displayed using the second display element, and a third mode in which an image is displayed using both the first display element and the second display element. The display device of this embodiment can be switched between the first mode, the second mode, and the third mode automatically or manually. Details of the first to third modes will be described below.

[First Mode]

In the first mode, an image is displayed using the first display element and external light. Because a light source is unnecessary in the first mode, power consumed in this mode is extremely low. When sufficient external light enters the display device (e.g., in a bright environment), for example, an image can be displayed by using light reflected by the first display element. The first mode is effective in the case where external light is white light or light near white light and is sufficiently strong, for example. The first mode is suitable for displaying text. Furthermore, the first mode enables eye-friendly display owing to the use of reflected external light, which leads to an effect of easing eyestrain. Note that the first mode may be referred to as reflective display mode (reflection mode) because display is performed using reflected light.

[Second Mode]

In the second mode, an image is displayed using light emitted by the second display element. Thus, an extremely vivid image (with high contrast and excellent color reproducibility) can be displayed regardless of the illuminance and the chromaticity of external light. The second mode is effective in the case of extremely low illuminance, such as in a night environment or in a dark room, for example. When a bright image is displayed in a dark environment, a user may feel that the image is too bright. To prevent this, an image with reduced luminance is preferably displayed in the second mode. In that case, glare can be reduced, and power consumption can also be reduced. The second mode is suitable for displaying a vivid (still and moving) image or the like. Note that the second mode may be referred to as emission display mode (emission mode) because display is performed using light emission, that is, emitted light.

[Third Mode]

In the third mode, display is performed utilizing both light reflected by the first display element and light emitted from the second display element. Note that display in which the first display element and the second display element are combined can be performed by driving the first display element and the second display element independently from each other during the same period. Note that in this specification and the like, display in which the first display element and the second display element are combined, i.e., the third mode, can be referred to as a hybrid display mode (HB display mode). Alternatively, the third mode may be referred to as a display mode in which an emission display mode and a reflective display mode are combined (ER-Hybrid mode).

By performing display in the third mode, a clearer image than in the first mode can be displayed and power consumption can be lower than in the second mode. For example, the third mode is effective when the illuminance is relatively low such as under indoor illumination or in the morning or evening hours, or when the external light does not represent a white chromaticity. With use of the combination of reflected light and emitted light, an image that makes a viewer feel like looking at a painting can be displayed.

Furthermore, the hybrid display device may display different images using the first display element and the second display element. For example, subtitles can be displayed using the first display element, and images can be displayed using the second display element. Accordingly, in the case of displaying both subtitles and images, the display device is driven in the above-described third mode.

In the case of not displaying subtitles, the second display element may display an image; thus, the display device may be driven in the above-described second mode. Note that in the case where the illuminance is high, the first display element may display an image; thus, the display device may be driven not in the second mode but in the first mode.

<Specific Example of First to Third Modes>

Here, a specific example of the case where the above-described first to third modes are employed is described with reference to FIGS. 10A to 10D and FIGS. 11A to 11D.

Note that the case where the first to third modes are switched automatically depending on the illuminance will be described below. In the case where the modes are switched automatically depending on the illuminance, an illuminance sensor or the like is provided in the display device and the display mode can be switched in response to data from the illuminance sensor, for example.

Figure 10A:
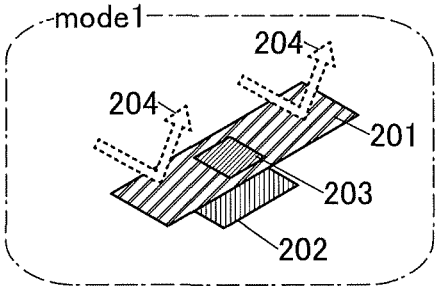
FIGS. 10A to 10D are schematic views illustrating structure examples of a display device.
Figure 10B:
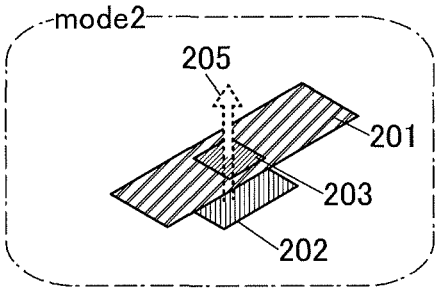
Figure 10C:
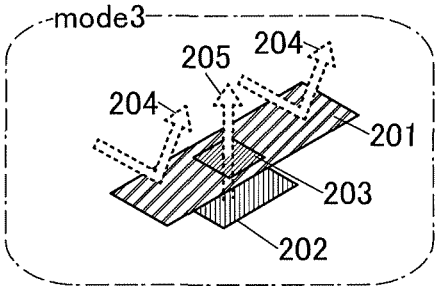

FIGS. 10A to 10C are schematic diagrams of a pixel for describing display modes that are possible for the display device in this embodiment.

In FIGS. 10A to 10C, a first display element 201, a second display element 202, an opening portion 203, reflected light 204 that is reflected by the first display element 201, and transmitted light 205 emitted from the second display element 202 through the opening portion 203 are illustrated. Note that FIG. 10A, FIG. 10B, and FIG. 10C are diagrams illustrating a first mode (mode 1), a second mode (mode 2), and a third mode (mode 3), respectively.

FIGS. 10A to 10C illustrate the case where a reflective liquid crystal element is used as the first display element 201 and a self-luminous OLED is used as the second display element 202.

In the first mode illustrated in FIG. 10A, grayscale display can be performed by driving the reflective liquid crystal element that is the first display element 201 to adjust the intensity of reflected light. For example, as illustrated in FIG. 10A, the intensity of the reflected light 204 reflected by the reflective electrode in the reflective liquid crystal element that is the first display element 201 is adjusted with the liquid crystal layer. In this manner, gray scale can be expressed.

In the second mode illustrated in FIG. 10B, grayscale can be expressed by adjusting the emission intensity of the self-luminous OLED that is the second display element 202. Note that light emitted from the second display element 202 passes through the opening portion 203 and is extracted to the outside as the transmitted light 205.

The third mode illustrated in FIG. 10C is a display mode in which the first mode and the second mode which are described above are combined. For example, as illustrated in FIG. 10C, the intensity of the reflected light 204 reflected by the reflective electrode in the reflective liquid crystal element that is the first display element 201 is adjusted with the liquid crystal layer. In a period during which the first display element 201 is driven, grayscale is expressed by adjusting the intensity of the self-luminous OLED that is the second display element 202, i.e., the intensity of the transmitted light 205.

<State Transition of First to Third Modes>

Figure 10D:
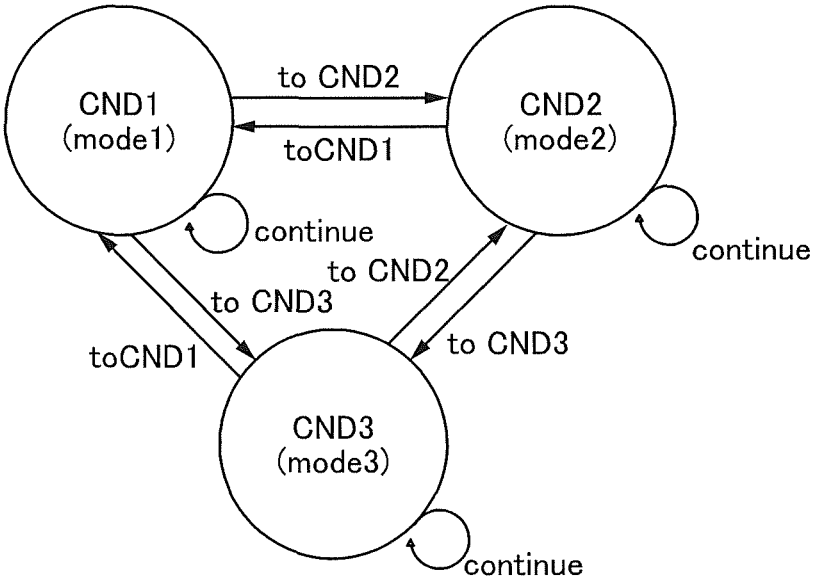

Next, a state transition of the first to third modes is described with reference to FIG. 10D. FIG. 10D is a state transition diagram of the first mode, the second mode, and the third mode. In FIG. 10D, a state CND1, a state CND2, and a state CND3 correspond to the first mode, the second mode, and the third mode, respectively.

As shown in FIG. 10D, any of the display modes can be selected with illuminance in the states CND1 to CND3. For example, under a high illuminance such as in the day time, the state can be brought into the state CND1. In the case where the illuminance decreases as time passes from day to night, the state CND1 transitions to the state CND2. In the case where the illuminance is low even in the day time and grayscale display with reflected light is not sufficient, the state CND1 transitions to the state CND3. Needless to say, transition from the state CND3 to the state CND1, transition from the state CND2 to the state CND3, transition from the state CND3 to the state CND2, or transition from the state CND2 to the state CND1 also occurs.

As shown in FIG. 10D, in the case where the illuminance does not change or slightly changes in the states CND1 to CND3, the present state may be maintained without transitioning to another state.

The above structure of switching the display mode in accordance with illuminance enables grayscale display in accordance with the illuminance. Furthermore, the grayscale display enables a reduction in the frequency of light emission of the light-emitting element which consumes a relatively large amount of power. Accordingly, the power consumption of the display device can be reduced. In the display device, the operation mode can be further switched in accordance with the amount of remaining battery power, the contents to be displayed, the illuminance of the surrounding environment. Although the case where the display mode is automatically switched with illuminance is described above as an example, one embodiment of the present invention is not limited thereto, and a user may switch the display mode manually.

<Operation Mode>

Next, an operation mode which can be employed in the first display element and the second display element will be described with reference to FIGS. 11A to 11D.

A normal driving mode (Normal mode) with a normal frame frequency (typically, higher than or equal to 60 Hz and lower than or equal to 240 Hz) and an idling stop (IDS) driving mode with a low frame frequency will be described below.

Note that the idling stop (IDS) driving mode refers to a method in which after image data is written, rewriting of image data is stopped. This increases the interval between writing of image data and subsequent writing of image data, thereby reducing the power that would be consumed by writing of image data in that interval. The idling stop (IDS) driving mode can be performed at a frame frequency which is 1/100 to 1/10 of the normal driving mode, for example.

Figure 11A:
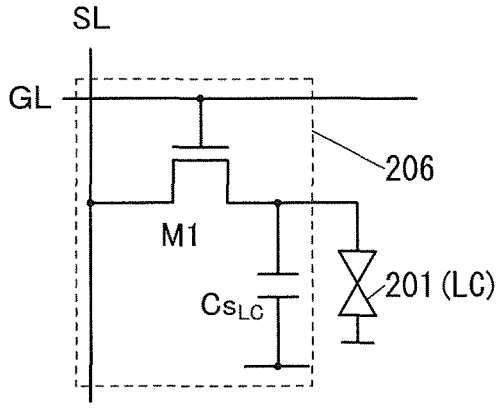
FIGS. 11A to 11D are circuit diagrams and timing charts showing a configuration example of a display device.
Figure 11B:
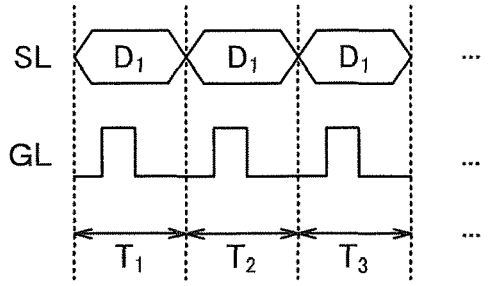
Figure 11C:
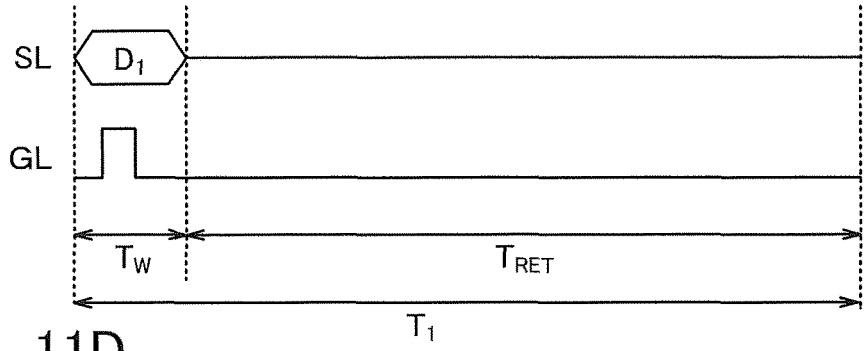

FIGS. 11A to 11C are a circuit diagram and timing charts illustrating the normal driving mode and the idling stop (IDS) driving mode. Note that in FIG. 11A, the first display element 201 (here, a liquid crystal element) and a pixel circuit 206 electrically connected to the first display element 201 are illustrated. In the pixel circuit 206 illustrated in FIG. 11A, a signal line SL, a gate line GL, a transistor M1 connected to the signal line SL and the gate line GL, and a capacitor $Cs_{LC}$ connected to the transistor M1 are illustrated.

A transistor including a metal oxide in a semiconductor layer is preferably used as the transistor M1. As a typical example of a transistor, a transistor including an oxide semiconductor, which is a kind of a metal oxide, (OS transistor) will be described. The OS transistor has an extremely low leakage current in a non-conduction state (off-state current), so that charge can be retained in a pixel electrode of a liquid crystal element when the OS transistor is turned off.

FIG. 11B is a timing chart showing waveforms of signals supplied to the signal line SL and the gate line GL in the normal driving mode. In the normal driving mode, a normal frame frequency (e.g., 60 Hz) is used for operation. In the case where one frame period is divided into periods $T_1$ to $T_3$, a scanning signal is supplied to the gate line GL in each frame period and data $D_1$ is written from the signal line SL. This operation is performed both to write the same data $D_1$ in the periods $T_1$ to $T_3$ and to write different data in the periods $T_1$ to $T_3$.

In contrast, FIG. 11C is a timing chart showing waveforms of signals supplied to the signal line SL and the gate line GL in the idling stop (IDS) driving mode. In the idling stop (IDS) driving, a low frame frequency (e.g., 1 Hz) is used for operation. One frame period is denoted by a period $T_1$ and includes a data writing period $T_W$ and a data retention period $T_{RET}$. In the idling stop (IDS) driving mode, a scanning signal is supplied to the gate line GL and the data $D_1$ of the signal line SL is written in the period $T_W$, the gate line GL is fixed to a low-level voltage in the period $T_{RET}$, and the transistor M1 is turned off so that the written data $D_1$ is retained.

The idling stop (IDS) driving mode is effective in combination with the aforementioned first mode or third mode, in which case power consumption can be further reduced.

Figure 11D:
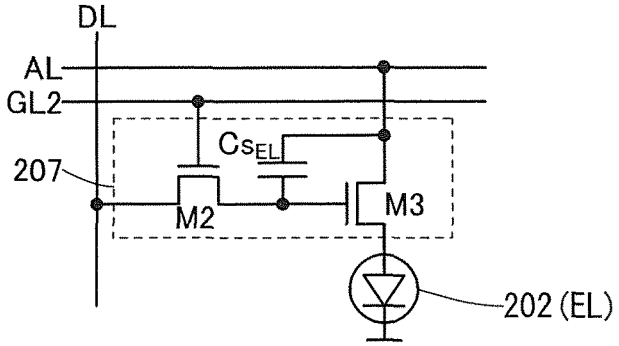

FIG. 11D illustrates the second display element 202 (here, an organic EL element) and a pixel circuit 207 electrically connected to the second display element. In the pixel circuit 207 illustrated in FIG. 11D, a signal line DL, a gate line GL2, a current supply line AL, a transistor M2 electrically connected to the signal line DL and the gate line GL2, a capacitor $Cs_{EL}$ electrically connected to the transistor M2 and the current supply line AL, and a transistor M3 electrically connected to the transistor M2, the capacitor $Cs_{EL}$, the current supply line AL, and the second display element 202 are illustrated.

The transistor M2 is preferably an OS transistor like the transistor M1. The OS transistor has an extremely low leakage current in an off state (off-state current), so that charge can be retained in the capacitor $Cs_{EL}$ when the OS transistor is in an off state. In other words, the gate-drain voltage of the transistor M3 can be kept constant, whereby the emission intensity of the second display element 202 can be constant.

Therefore, as in the idling stop (IDS) driving of the first display element, a scan signal is supplied to the gate line GL2, the voltage of the gate line GL2 is fixed at a low-level voltage after data is written from the signal line DL, and the transistor M2 is turned off and the written data is retained in the idling stop (IDS) driving of the second display element.

The transistor M3 is preferably formed using a material similar to that of the transistor M2. The use of the same material in the transistor M3 and the transistor M2 can shorten the fabrication process of the pixel circuit 207.

The idling stop (IDS) driving mode is effective in combination with the aforementioned first to third modes, in which case power consumption can be further reduced.

As described above, the display device of this embodiment can display an image by switching between the first to third modes. Thus, an all-weather display device or a highly convenient display device with high visibility regardless of the ambient brightness can be fabricated.

The display device of this embodiment preferably includes a plurality of first pixels including first display elements and a plurality of second pixels including second display elements. The first pixels and the second pixels are preferably arranged in matrices.

Each of the first pixels and the second pixels can include one or more sub-pixels. The pixel can include, for example, one sub-pixel (e.g., a white (W) sub-pixel), three sub-pixels (e.g., red (R), green (G), and blue (B) sub-pixels), or four sub-pixels (e.g., red (R), green (G), blue (B), and white (W) sub-pixels, or red (R), green (G), blue (B), and yellow (Y) sub-pixels). Note that color elements included in the first and second pixels are not limited to the above, and may be combined with another color such as cyan (C), magenta (M), or the like as necessary.

The display device of this embodiment can be configured to display a color image using either the first pixels or the second pixels. Alternatively, the display device of this embodiment can be configured to display a black-and-white image or a grayscale image using the first pixels and can display a full-color image using the second pixels. The first pixels that can be used for displaying a black-and-white image or a grayscale image are suitable for displaying information that need not be displayed in color such as text information.

<Schematic Perspective View of Display Device>

Figure 12:
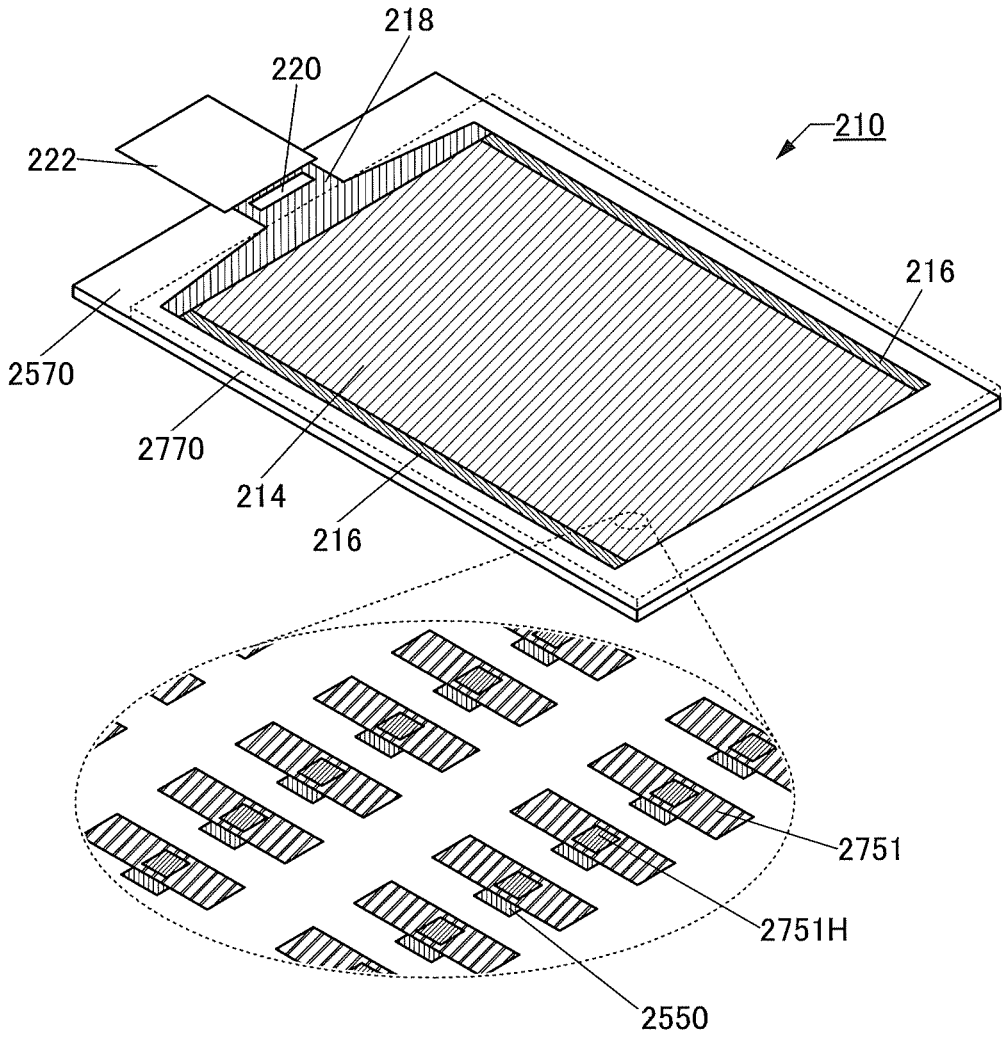
FIG. 12 is a perspective view illustrating an example of a display device.

Next, a display device of this embodiment is described with reference to FIG. 12. FIG. 12 is a schematic perspective view of a display device 210.

In the display device 210, a substrate 2570 and a substrate 2770 are attached to each other. In FIG. 12, the substrate 2770 is denoted by a dashed line.

The display device 210 includes a display portion 214 (corresponding to the display portion 106 described in the above embodiment), a circuit 216, a wiring 218, and the like. FIG. 12 illustrates an example in which the display device 210 is provided with an IC 220 and an FPC 222. Thus, the structure illustrated in FIG. 12 can be regarded as a display module including the display device 210, the IC 220, and the FPC 222.

As the circuit 216, for example, a scanning line driver circuit (corresponding to the gate driver 103 described in the above embodiment) can be used.

The wiring 218 has a function of supplying a signal and power to the display portion 214 and the circuit 216. The signal and the power are inputted to the wiring 218 from the outside through the FPC 222 or from the IC 220.

FIG. 12 illustrates an example in which the IC 220 is provided over the substrate 2570 by a COG method, a COF method, or the like. As the IC 220, an IC including, for example, the scanning line driver circuit, a signal line driver circuit (corresponding to the source driver 111 described in the above embodiment), a level shifter (corresponding to the level shifter 104 described in the above embodiment), a controller (corresponding to the display controller 400A or 400C described in the above embodiment), or the like can be used. Note that the display device 210 is not necessarily provided with the IC 220. The IC 220 may be mounted on the FPC by a COF method or the like.

FIG. 12 also illustrates an enlarged view of part of the display portion 214. Electrodes 2751 included in a plurality of display elements are arranged in a matrix in the display portion 214. The electrode 2751 has a function of reflecting visible light and accordingly functions as a reflective electrode of a first display element 2750 (corresponding to the reflective element 10*a* described in the above embodiment, which is described later) as a liquid crystal element.

Furthermore, as illustrated in FIG. 12, the electrode 2751 includes a region 2751H as an opening. Moreover, the display portion 214 includes a second display element 2550 (corresponding to the light-emitting element 10*b* described in the above embodiment) as a light-emitting element positioned closer to the substrate 2570 side than the electrode 2751 is. Light from the second display element 2550 is emitted to the substrate 2770 side through the region 2751H of the electrode 2751. The area of a light-emitting region in the second display element 2550 may be equal to that of the region 2751H. One of the area of the light-emitting region in the second display element 2550 and the area of the region 2751H is preferably larger than the other because a margin for misalignment can be increased.

<Cross-Sectional View of Input/Output Panel>

A structure of an input/output panel in which a touch sensor unit is provided in the display device 210 illustrated in FIG. 12 will be described with reference to FIG. 13 and FIGS. 14A to 14D.

Figure 13:
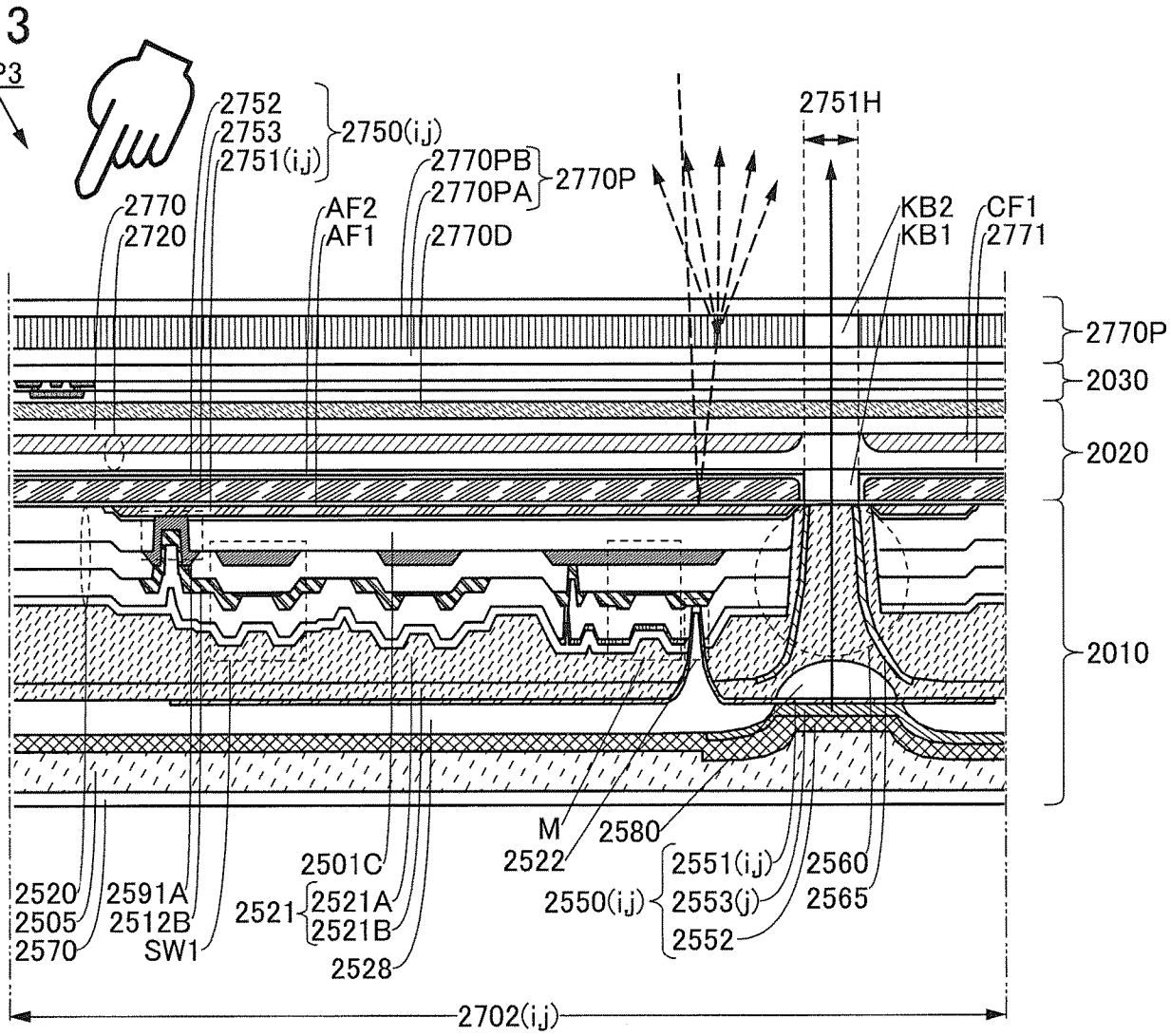
FIG. 13 is a cross-sectional view illustrating a structure example of an input/output panel.

FIG. 13 is a cross-sectional view of a pixel included in an input/output panel 2700TP3.

Figures 14A, 14B, 14C, 14D:
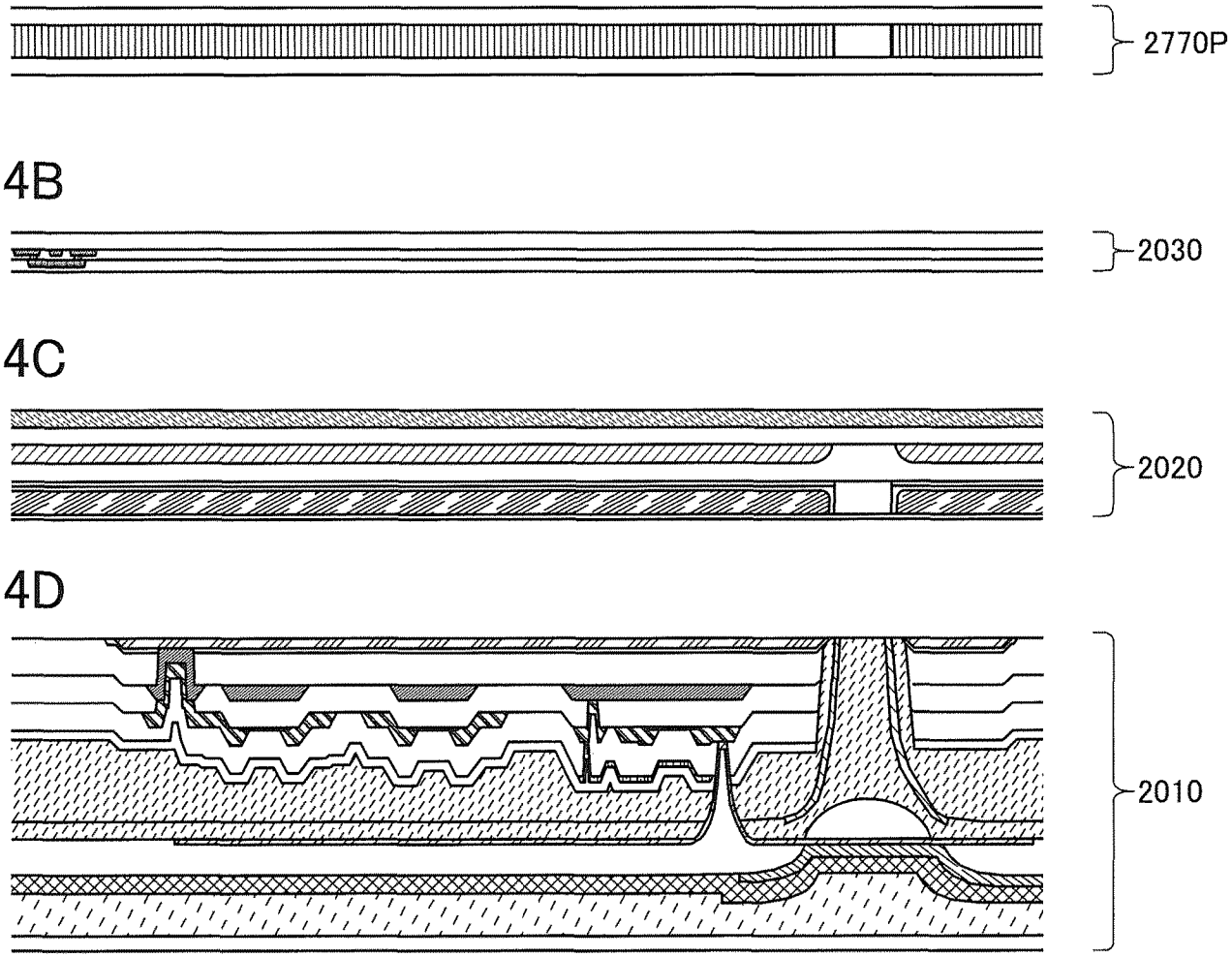
FIGS. 14A to 14D are cross-sectional views illustrating a structure example of an input/output panel.

FIGS. 14A to 14D illustrate the structure of the input/output panel of one embodiment of the present invention. FIG. 14A is a cross-sectional view illustrating a functional film of the input/output panel in FIG. 13. FIG. 14B is a cross-sectional view illustrating a structure of an input unit. FIG. 14C is a cross-sectional view illustrating a structure of a second unit. FIG. 14D is a cross-sectional view illustrating a structure of a first unit.

The input/output panel 2700TP3 described in this structure example includes a pixel 2702(*i*,*j*) (see FIG. 13). The input/output panel 2700TP3 includes a first unit 2010, a second unit 2020, an input unit 2030, and a functional film 2770P (see FIGS. 14A to 14D). The first unit 2010 includes a functional layer 2520, and the second unit 2020 includes a functional layer 2720.

<<Pixel 2702(*i*,*j*)>>

The pixel 2702(*i*,*j*) includes a portion of the functional layer 2520, a first display element 2750(*i*,*j*), and a second display element 2550(*i*,*j*) (see FIG. 13).

The functional layer 2520 includes a first conductive film, a second conductive film, an insulating film 2501C, and a pixel circuit. The pixel circuit includes the transistor M, for example. The functional layer 2520 includes an optical element 2560, a covering film 2565, and a lens 2580. Although not illustrated, the functional layer 2520 may include an insulating film 2528 and/or an insulating film 2521. A stack including an insulating film 2521A and an insulating film 2521B can be used as the insulating film 2521.

For example, a material whose refractive index is around 1.55 can be used for the insulating film 2521A or the insulating film 2521B. Alternatively, a material whose refractive index is around 1.6 can be used for the insulating film 2521A or the insulating film 2521B. Further alternatively, an acrylic resin or polyimide can be used for the insulating film 2521A or the insulating film 2521B.

The insulating film 2501C includes a region positioned between the first conductive film and the second conductive film and has an opening 2591A.

The first conductive film is electrically connected to the first display element 2750(*i*,*j*). Specifically, the first conductive film is electrically connected to an electrode 2751(*i*,*j*) of the first display element 2750(*i*,*j*). The electrode 2751(*i*,*j*) can be used as the first conductive film.

The second conductive film includes a region overlapping with the first conductive film. The second conductive film is electrically connected to the first conductive film through the opening 2591A. For example, the conductive film 2512B can be used as the second conductive film. The second conductive film is electrically connected to the pixel circuit. For example, a conductive film which functions as a source electrode or a drain electrode of a transistor used as a switch SW1 of the pixel circuit can be used as the second conductive film. Note that the first conductive film electrically connected to the second conductive film in the opening 2591A that is formed in the insulating film 2501C can be referred to as a through electrode.

The second display element 2550(*i*,*j*) is electrically connected to the pixel circuit. The second display element 2550(*i*,*j*) has a function of emitting light toward the functional layer 2520. The second display element 2550(*i*,*j*) has a function of emitting light toward the lens 2580 or the optical element 2560, for example.

The second display element 2550(*i*,*j*) is provided so that the display using the second display element 2550(*i*,*j*) can be seen from part of a region from which the display using the first display element 2750(*i*,*j*) can be seen. For example, the electrode 2751(*i*,*j*) of the first display element 2750(*i*,*j*) includes the region 2751H where light emitted from the second display element 2550(*i*,*j*) is not blocked. Note that dashed arrows illustrated in FIG. 13 denote the directions in which external light is incident on and reflected by the first display element 2750(*i*,*j*) that displays image data by controlling the intensity of external light reflection. In addition, a solid arrow illustrated in FIG. 13 denotes the direction in which the second display element 2550(*i*,*j*) emits light to the part of the region from which the display using the first display element 2750(*i*,*j*) can be seen.

Accordingly, display using the second display element can be seen from part of the region where display using the first display element can be seen. Alternatively, a user can see display without changing the attitude or the like of the input/output panel. Alternatively, an object color expressed by light reflected by the first display element and a light source color expressed by light emitted from the second display element can be mixed. Alternatively, an object color and a light source color can be used to display an image like a painting. As a result, a novel input/output panel that is highly convenient or reliable can be provided.

For example, the first display element 2750(*i*,*j*) includes the electrode 2751(*i*,*j*), an electrode 2752, and a layer 2753 containing a liquid crystal material. The first display element 2750(*i*,*j*) further includes an alignment film AF1 and an alignment film AF2. Specifically, a reflective liquid crystal element can be used as the first display element 2750(*i*,*j*).

For example, a transparent conductive film whose refractive index is around 2.0 can be used as the electrode 2752 or the electrode 2751(*i*,*j*). Specifically, an oxide including indium, tin, and silicon can be used for the electrode 2752 or the electrode 2751(*i*,*j*). Alternatively, a material whose refractive index is around 1.6 can be used for the alignment film. The dielectric anisotropy and resistivity of the liquid crystal layer are preferably greater than or equal to 2 and less than or equal to 3.8 and higher than or equal to $1.0\times10^{14}$ Ω·cm and lower than or equal to $1.0\times10^{15}$ Ω·cm, respectively. In that case, the IDS driving can be performed and power consumption of the input/output panel can be reduced.

For example, the second display element 2550(*i*,*j*) includes an electrode 2551(*i*,*j*), an electrode 2552, and a layer 2553(*j*) containing a light-emitting material. The electrode 2552 includes a region overlapping with the electrode 2551(*i*,*j*). The layer 2553(*j*) containing a light-emitting material includes a region positioned between the electrode 2551(*i*,*j*) and the electrode 2552. The electrode 2551(*i*,*j*) is electrically connected to the pixel circuit at a connection portion 2522. Specifically, an organic EL element can be used as the second display element 2550(*i*,*j*).

For example, a transparent conductive film having a refractive index of around 2.0 can be used as the electrode 2551(*i*,*j*). Specifically, an oxide including indium, tin, and silicon can be used for the electrode 2551(*i*,*j*). Alternatively, a material whose refractive index is around 1.8 can be used for the layer 2553(*j*) containing a light-emitting material.

The optical element 2560 has a light-transmitting property and includes a first region, a second region, and a third region.

The first region includes a region to which visible light is supplied from the second display element 2550(*i*,*j*), the second region includes a region in contact with the covering film 2565, and the third region has a function of emitting part of visible light. The third region has an area smaller than or equal to the area of the region of the first region to which visible light is supplied.

The covering film 2565 has reflectivity with respect to visible light and has a function of reflecting part of visible light and supplying it to the third region.

For example, a metal can be used for the covering film 2565. Specifically, a material containing silver can be used for the covering film 2565. For example, a material containing silver, palladium, and the like or a material containing silver, copper, and the like can be used for the covering film 2565.

<<Lens 2580>>

A material that transmits visible light can be used for the lens 2580. Alternatively, a material whose refractive index is greater than or equal to 1.3 and less than or equal to 2.5 can be used for the lens 2580. For example, an inorganic material or an organic material can be used for the lens 2580.

For example, a material including an oxide or a sulfide can be used for the lens 2580.

Specifically, cerium oxide, hafnium oxide, lanthanum oxide, magnesium oxide, niobium oxide, tantalum oxide, titanium oxide, yttrium oxide, zinc oxide, an oxide including indium and tin, an oxide including indium, gallium, and zinc, or the like can be used for the lens 2580. Alternatively, zinc sulfide or the like can be used for the lens 2580.

For example, the lens 2580 can be formed using a material including resin. Specifically, the lens 2580 can be formed using a resin to which chlorine, bromine, or iodine is introduced, a resin to which a heavy metal atom is introduced, a resin to which an aromatic ring is introduced, a resin to which sulfur is introduced, or the like. Alternatively, the lens 2580 can be formed using a material containing a resin and nanoparticles of a material whose refractive index is higher than that of the resin. As a nanoparticle having high refractive index, titanium oxide, zirconium oxide, or the like can be used for the nanoparticle.

<<Functional Layer 2720>>

The functional layer 2720 includes a region positioned between the substrate 2770 and the insulating film 2501C. The functional layer 2720 further includes an insulating film 2771 and a coloring film CF1.

The coloring film CF1 includes a region positioned between the substrate 2770 and the first display element 2750(*i*,*j*).

The insulating film 2771 includes a region positioned between the coloring film CF1 and the layer 2753 containing a liquid crystal material. The insulating film 2771 can reduce unevenness due to the thickness of the coloring film CF1. Furthermore, the insulating film 2771 can prevent impurities from diffusing from the coloring film CF1 or the like to the layer 2753 containing a liquid crystal material.

For example, an acrylic resin whose refractive index is around 1.55 can be used for the insulating film 2771.

<<Substrate 2570 and Substrate 2770>>

The input/output panel described in this embodiment includes the substrate 2570 and the substrate 2770.

The substrate 2770 includes a region overlapping with the substrate 2570. The substrate 2770 includes a region provided so that the functional layer 2520 is positioned between the substrate 2770 and the substrate 2570.

The substrate 2770 includes a region overlapping with the first display element 2750(*i*,*j*). For example, a material with low birefringence can be used for the region.

For example, a resin material whose refractive index is around 1.5 can be used for the substrate 2770.

<<Bonding Layer 2505>>

The input/output panel described in this embodiment also includes a bonding layer 2505.

The bonding layer 2505 includes a region positioned between the functional layer 2520 and the substrate 2570, and has a function of bonding the functional layer 2520 and the substrate 2570 together.

<<Structures KB1 and KB2>>

The input/output panel described in this embodiment includes a structure body KB1 and a structure body KB2.

The structure body KB1 has a function of providing a certain space between the functional layer 2520 and the substrate 2770. The structure body KB1 includes a region overlapping with the region 2751H and has a light-transmitting property. Thus, light emitted from the second display element 2550(*i*,*j*) can be supplied to one surface of the structure body KB1 and emitted from the other surface.

Furthermore, the structure body KB1 includes a region overlapping with the optical element 2560 and is formed using a material whose refractive index is different from that of a material used for the optical element 2560 by 0.2 or less, for example. Accordingly, light emitted from the second display element can be used efficiently. Alternatively, the area of the second display element can be increased. The density of current flowing through the organic EL element can be decreased.

The structure body KB2 has a function of controlling the thickness of a polarizing layer 2770PB to a predetermined thickness. The structure body KB2 includes a region overlapping with the second display element 2550(*i*,*j*) and has a light-transmitting property.

Alternatively, a material that transmits light of a predetermined color can be used for the structure body KB1 or KB2. Thus, the structure body KB1 or KB2 can be used, for example, as a color filter. For example, a material that transmits blue light, green light, or red light can be used for the structure body KB1 or KB2. A material that transmits yellow light, white like, or the like can be used for the structure body KB1 or KB2.

Specifically, for the structures KB1 and KB2, polyester, polyolefin, polyamide, polyimide, polycarbonate, polysiloxane, an acrylic resin, or the like, or a composite material of a plurality of kinds of resins selected from these can be used. Alternatively, a photosensitive material may be used.

For example, an acrylic resin whose refractive index is around 1.5 can be used for the structure body KB1. An acrylic resin whose refractive index is around 1.55 can be used for the structure body KB2.

<<Input Unit 2030>>

The input unit 2030 includes a sensor element. The sensor element has a function of sensing an object that approaches a region overlapping with the pixel 2702(*i*,*j*). Accordingly, a finger or the like close to a display portion can be used as a pointer to input positional information.

For example, a capacitive proximity sensor, an electromagnetic inductive proximity sensor, an optical proximity sensor, a resistive proximity sensor, or a surface acoustic wave proximity sensor can be used as the input unit 2030. Specifically, a surface capacitive proximity sensor, a projected capacitive proximity sensor, or an infrared proximity sensor can be used.

For example, a touch sensor which includes a capacitive proximity sensor and whose refractive index is around 1.6 can be used as the input unit 2030.

<<Functional Film 2770D, Functional Film 2770P, and the Like>>

The input/output panel 2700TP3 described in this embodiment includes a functional film 2770D and the functional film 2770P.

The functional film 2770D includes a region overlapping with the first display element 2750(*i,j*). The functional film 2770D includes a region provided so that the first display element 2750(*i,j*) is positioned between the functional film 2770D and the functional layer 2520.

For example, a light diffusion film can be used as the functional film 2770D. Specifically, a material with a columnar structure having an axis along the direction intersecting a surface of a base can be used for the functional film 2770D. In that case, light can be transmitted in the direction along the axis and scattered in other directions easily. For example, light reflected by the first display element 2750(*i,j*) can be diffused.

The functional film 2770P includes the polarizing layer 2770PB, a retardation film 2770PA, and the structure body KB2. The polarizing layer 2770PB includes an opening, and the retardation film 2770PA includes a region overlapping with the polarizing layer 2770PB. Note that the structure body KB2 is provided in the opening.

For example, a dichromatic pigment, a liquid crystal material, and a resin can be used for the polarizing layer 2770PB. The polarizing layer 2770PB has a polarization property. In that case, the functional film 2770P can be used as a polarizing plate.

The polarizing layer 2770PB includes a region overlapping with the first display element 2750(*i,j*), and the structure body KB2 includes a region overlapping with the second display element 2550(*i,j*). Thus, a liquid crystal element can be used as the first display element. For example, a reflective liquid crystal element can be used as the first display element. Light emitted from the second display element can be extracted efficiently. The density of current flowing through the organic EL element can be decreased. The reliability of the organic EL element can be increased.

For example, an anti-reflection film, a polarizing film, or a retardation film can be used as the functional film 2770P. Specifically, a film including a dichromatic pigment and a retardation film can be used as the functional film 2770P.

Alternatively, an antistatic film preventing the attachment of a foreign substance, a water repellent film suppressing the attachment of stain, a hard coat film suppressing a scratch in use, or the like can be used as the functional film 2770P.

For example, a material whose refractive index is around 1.6 can be used for the diffusion film. A material whose refractive index is around 1.6 can be used for the retardation film 2770PA.

Note that this embodiment can be combined with any of the other embodiments in this specification as appropriate.

Embodiment 5

Described in this embodiment is a metal oxide applicable to a transistor disclosed in this specification. In particular, the details of a metal oxide and a cloud-aligned composite (CAC)-OS are described below.

A CAC-OS or a CAC metal oxide has a conducting function in a part of the material and has an insulating function in another part of the material; as a whole, the CAC-OS or the CAC metal oxide has a function of a semiconductor. In the case where the CAC-OS or the CAC metal oxide is used in a channel formation region of a transistor, the conducting function is to allow electrons (or holes) serving as carriers to flow, and the insulating function is to not allow electrons serving as carriers to flow. By the complementary action of the conducting function and the insulating function, the CAC-OS or the CAC metal oxide can have a switching function (on/off function). In the CAC-OS or CAC-metal oxide, separation of the functions can maximize each function.

The CAC-OS or the CAC metal oxide includes conductive regions and insulating regions. The conductive regions have the above-described conducting function, and the insulating regions have the above-described insulating function. In some cases, the conductive regions and the insulating regions in the material are separated at the nanoparticle level. In some cases, the conductive regions and the insulating regions are unevenly distributed in the material. The conductive regions are observed to be coupled in a cloud-like manner with their boundaries blurred, in some cases.

Furthermore, in the CAC-OS or the CAC metal oxide, the conductive regions and the insulating regions each have a size more than or equal to 0.5 nm and less than or equal to 10 nm, preferably more than or equal to 0.5 nm and less than or equal to 3 nm and are dispersed in the material, in some cases.

The CAC-OS or the CAC metal oxide includes components having different bandgaps. For example, the CAC-OS or the CAC metal oxide includes a component having a wide gap due to the insulating region and a component having a narrow gap due to the conductive region. In the case of such a composition, carriers mainly flow in the component having a narrow gap. The component having a narrow gap complements the component having a wide gap, and carriers also flow in the component having a wide gap in conjunction with the component having a narrow gap. Therefore, in the case where the above-described CAC-OS or the CAC metal oxide is used in a channel formation region of a transistor, high current drive capability in the on state of the transistor, that is, a high on-state current and high field-effect mobility, can be obtained.

In other words, CAC-OS or CAC-metal oxide can be called a matrix composite or a metal matrix composite. Thus, CAC-OS may be called a cloud-aligned composite OS.

The CAC-OS has, for example, a composition in which elements included in a metal oxide are unevenly distributed. Materials including unevenly distributed elements each have a size greater than or equal to 0.5 nm and less than or equal to 10 nm, preferably greater than or equal to 1 nm and less than or equal to 2 nm, or a similar size. Note that in the following description of a metal oxide, a state in which one or more metal elements are unevenly distributed and regions including the metal element(s) are mixed is referred to as a mosaic pattern or a patch-like pattern. The regions each have a size greater than or equal to 0.5 nm and less than or equal to 10 nm, preferably greater than or equal to 1 nm and less than or equal to 2 nm, or a similar size.

Note that a metal oxide preferably contains at least indium. In particular, indium and zinc are preferably contained. In addition, aluminum, gallium, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like may be contained.

For example, of the CAC-OS, an In—Ga—Zn oxide with the CAC composition (such an In—Ga—Zn oxide may be particularly referred to as CAC-IGZO) has a composition in which materials are separated into indium oxide ($InO_{X1}$, where X1 is a real number greater than 0) or indium zinc oxide ($In_{X2}Zn_{Y2}O_{Z2}$, where X2, Y2, and Z2 are real numbers greater than 0), and gallium oxide ($GaO_{X3}$, where X3 is a real number greater than 0), or gallium zinc oxide ($Ga_{X4}Zn_{Y4}O_{Z4}$, where X4, Y4, and Z4 are real numbers greater than 0), and a mosaic pattern is formed. Then, $InO_{X1}$ or $In_{X2}Zn_{Y2}O_{Z2}$ forming the mosaic pattern is evenly distributed in the film. This composition is also referred to as a cloud-like composition.

That is, the CAC-OS is a composite metal oxide with a composition in which a region including $GaO_{X3}$ as a main component and a region including $In_{X2}Zn_{Y2}O_{Z2}$ or $InO_{X1}$ as a main component are mixed. Note that in this specification, for example, when the atomic ratio of In to an element M in a first region is greater than the atomic ratio of In to an element M in a second region, the first region has higher In concentration than the second region.

Note that a compound including In, Ga, Zn, and O is also known as IGZO. Typical examples of IGZO include a crystalline compound represented by $InGaO_3(ZnO)_{m1}$ (m1 is a natural number) and a crystalline compound represented by $In_{(1+x0)}Ga_{(1-x0)}O_3(ZnO)_{m0}$ ($-1 \leq x0 \leq 1$; m0 is a given number).

The crystalline compound has a single crystal structure, a polycrystalline structure, or a c-axis aligned crystalline (CAAC) structure. Note that the CAAC structure is a crystal structure in which a plurality of IGZO nanocrystals have c-axis alignment and are connected in the a-b plane direction without alignment.

On the other hand, the CAC-OS relates to the material composition of a metal oxide. In part of the material composition of a CAC-OS containing In, Ga, Zn, and O, nanoparticle regions including Ga as a main component and nanoparticle regions including In as a main component are observed. These nanoparticle regions are randomly dispersed to form a mosaic pattern. Therefore, the crystal structure is a secondary element for the CAC-OS.

Note that in the CAC-OS, a stacked-layer structure including two or more films with different atomic ratios is not included. For example, a two-layer structure of a film including In as a main component and a film including Ga as a main component is not included.

A boundary between the region including $GaO_{X3}$ as a main component and the region including $In_{X2}Zn_{Y2}O_{Z2}$ or $InO_{X1}$ as a main component is not clearly observed in some cases.

In the case where one or more of aluminum, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like are contained instead of gallium in a CAC-OS, nanoparticle regions including the selected metal element(s) as a main component(s) are observed in part of the CAC-OS and nanoparticle regions including In as a main component are observed in part thereof, and these nanoparticle regions are randomly dispersed to form a mosaic pattern in the CAC-OS.

The CAC-OS can be formed by a sputtering method under conditions where a substrate is not heated intentionally, for example. In the case of forming the CAC-OS by a sputtering method, one or more selected from an inert gas (typically, argon), an oxygen gas, and a nitrogen gas may be used as a deposition gas. The ratio of the flow rate of an oxygen gas to the total flow rate of the deposition gas at the time of deposition is preferably as low as possible, and for example, the flow ratio of an oxygen gas is preferably higher than or equal to 0% and lower than 30%, further preferably higher than or equal to 0% and lower than or equal to 10%.

The CAC-OS is characterized in that no clear peak is observed in measurement using $\theta/2\theta$ scan by an out-of-plane method, which is an X-ray diffraction (XRD) measurement method. That is, X-ray diffraction shows no alignment in the a-b plane direction and the c-axis direction in a measured region.

In an electron diffraction pattern of the CAC-OS which is obtained by irradiation with an electron beam with a probe diameter of 1 nm (also referred to as a nanometer-sized electron beam), a ring-like region with high luminance and a plurality of bright spots in the ring-like region are observed. Therefore, the electron diffraction pattern indicates that the crystal structure of the CAC-OS includes a nanocrystal (nc) structure with no alignment in plan-view and cross-sectional directions.

For example, an energy dispersive X-ray spectroscopy (EDX) mapping image confirms that an In—Ga—Zn oxide with the CAC composition has a structure in which a region including $GaO_{X3}$ as a main component and a region including $In_{A2}Zn_{Y2}O_{Z2}$ or $InO_{X1}$ as a main component are unevenly distributed and mixed.

The CAC-OS has a structure different from that of an IGZO compound in which metal elements are evenly distributed, and has characteristics different from those of the IGZO compound. That is, in the CAC-OS, regions including $GaO_{X3}$ or the like as a main component and regions including $In_{X2}Zn_{Y2}O_{Z2}$ or $InO_{X1}$ as a main component are separated to form a mosaic pattern.

The conductivity of a region including $In_{X2}Zn_{Y2}O_{Z2}$ or $InO_{X1}$ as a main component is higher than that of a region including $GaO_{X3}$ or the like as a main component. In other words, when carriers flow through regions including $In_{X2}Zn_{Y2}O_{Z2}$ or $InO_{X1}$ as a main component, the conductivity of an oxide semiconductor is generated. Accordingly, when regions including $In_{X2}Zn_{Y2}O_{Z2}$ or $InO_{X1}$ as a main component are distributed in an oxide semiconductor like a cloud, high field-effect mobility ($\mu$) can be achieved.

In contrast, the insulating property of a region including $GaO_{X3}$ or the like as a main component is higher than that of a region including $In_{X2}Zn_{Y2}O_{Z2}$ or $InO_{X1}$ as a main component. In other words, when regions including $GaO_{X3}$ or the like as a main component are distributed in an oxide semiconductor, leakage current can be suppressed and favorable switching operation can be achieved.

Accordingly, when a CAC-OS is used for a semiconductor element, the insulating property derived from $GaO_{X3}$ or the like and the conductivity derived from $In_{X2}Zn_{Y2}O_{Z2}$ or $InO_{X1}$ complement each other, whereby high on-state current ($I_{on}$) and high field-effect mobility ($\mu$) can be achieved.

A semiconductor element including a CAC-OS has high reliability. Thus, the CAC-OS is suitably used in a variety of semiconductor devices typified by a display.

This embodiment can be combined with any of the other embodiments in this specification as appropriate.

Embodiment 6

In this embodiment, an example of a touch sensor unit that can be provided in an electronic device described in Embodiment 2 will be described.

Figure 15A:
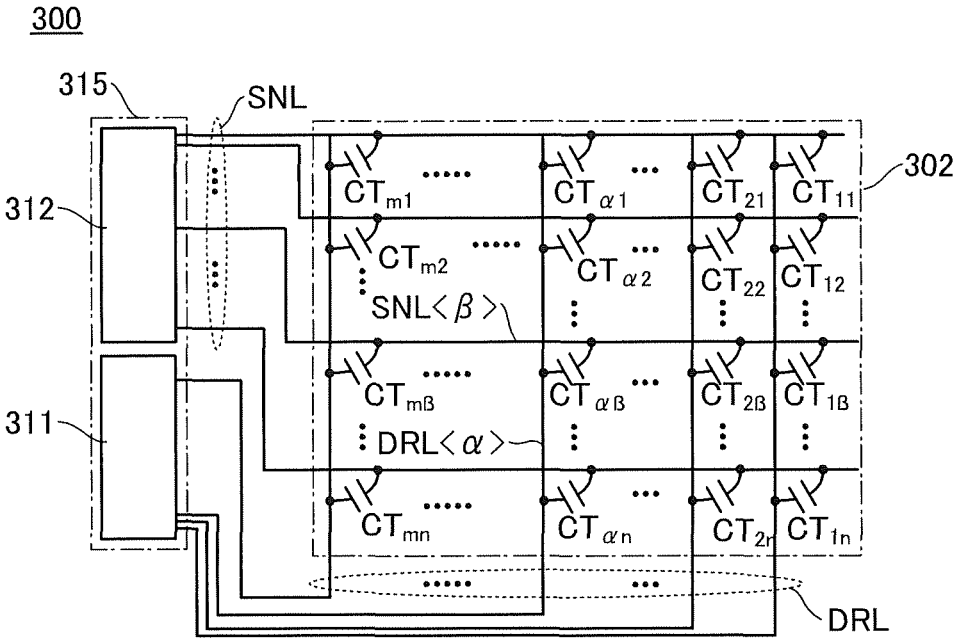
FIGS. 15A and 15B are a circuit diagram illustrating a configuration example of a touch sensor unit and a top view illustrating an example of a schematic view of the touch sensor unit.

FIG. 15A shows a circuit configuration example of a touch sensor unit that can be provided in the display device described in another embodiment. The touch sensor unit 300 includes the sensor array 302, the TS driver circuit 311, and the sense circuit 312. In FIG. 15A, the TS driver circuit 311 and the sensing circuit 312 are collectively illustrated as the peripheral circuit 315.

Here, a structure example of the touch sensor unit 300 which is a mutual capacitive touch sensor unit is illustrated. The sensor array 302 includes in wirings DRL (here, m is an integer larger than 1) and n wirings SNL (here, n is an integer larger than 1). The wiring DRL is a driving line, and the wiring SNL is a sensing line. Here, the α-th wiring DRL is referred to as a wiring DRL<α>, and the β-th wiring SNL is referred to as a wiring SNL<β>. A capacitor $CT_{\alpha\beta}$ refers to a capacitor formed between the wiring DRL<α> and the wiring SNL<β>.

The in wirings DRL are electrically connected to the TS driver circuit 311. The TS driver circuit 311 has a function of driving each wiring DRL. The n wirings SNL are electrically connected to the sense circuit 312. The sense circuit 312 has a function of sensing signals of the wirings SNL. A signal of the wiring SNL<β> at the time when the wiring DRL<α> is driven by the TS driver circuit 311 includes information on the amount of change in capacitance of the capacitor $CT_{\alpha\beta}$. By analyzing signals of n wirings SNL, information on the presence or absence of touch, the touch position, and the like can be obtained.

Figure 15B:
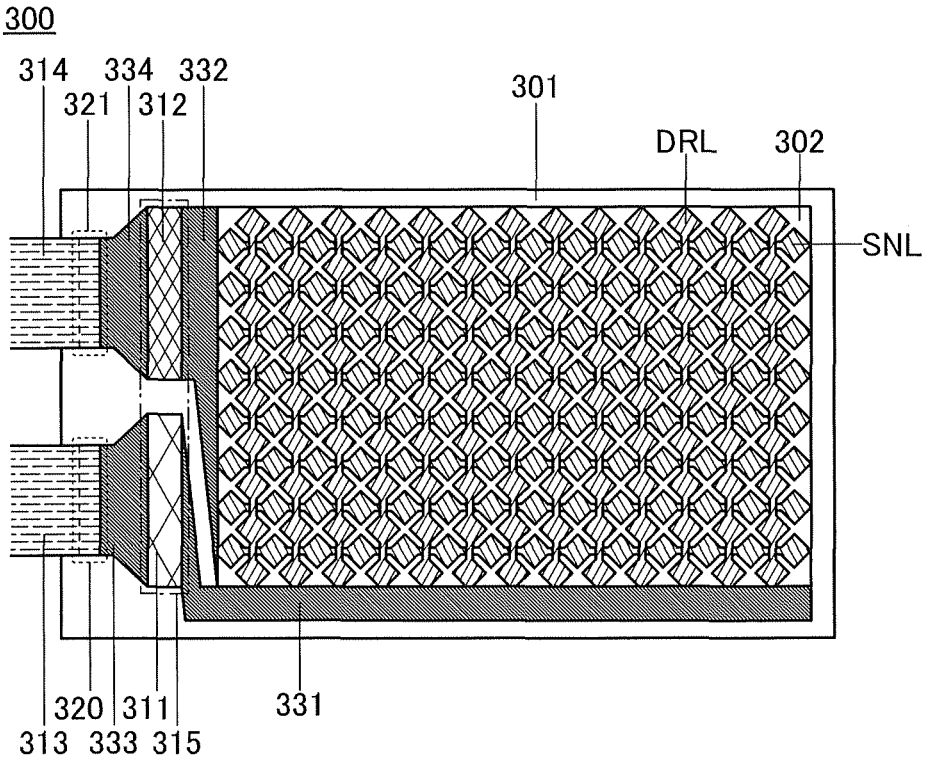

FIG. 15B is a top view illustrating an example of a schematic view of the touch sensor unit 300. The touch sensor unit 300 in FIG. 15B includes the sensor array 302 over a base 301, the TS driver circuit 311, and the sense circuit 312. In FIG. 15B, the TS driver circuit 311 and the sense circuit 312 are collectively illustrated as the peripheral circuit 315 as in FIG. 15A.

The sensor array 302 is formed over the base 301. The TS driver circuit 311 and the sense circuit 312 can be mounted as components of an IC chip or the like, over the base 301, using an anisotropic conductive adhesive or an anisotropic conductive film by a COG method, a COF method, or the like. The touch sensor unit 300 is electrically connected to an FPC 313 and an FPC 314 as units for inputting a signal or the like from the outside.

In addition, wirings 331 to 334 are formed over the base 301 so that the circuits are electrically connected to each other. In the touch sensor unit 300, the TS driver circuit 311 is electrically connected to the sensor array 302 through the wiring 331, and the TS driver circuit 311 is electrically connected to the FPC 313 through the wiring 333. The sense circuit 312 is electrically connected to the sensor array 302 through the wiring 332, and the TS driver circuit 311 is electrically connected to the FPC 314 through the wiring 334.

A connection portion 320 between the wiring 333 and the FPC 313 has an anisotropic conductive adhesive, whereby electrical conduction between the FPC 313 and the wiring 333 can be obtained. Also, a connection portion 321 between the wiring 334 and the FPC 314 has an anisotropic conductive adhesive, whereby electrical conduction between the FPC 314 and the wiring 334 can be obtained.

This embodiment can be combined with any of the other embodiments in this specification as appropriate.

Embodiment 7

In this embodiment, examples of product using the electronic device described in the above embodiment will be described.

<Notebook Personal Computer>

Figure 16A:
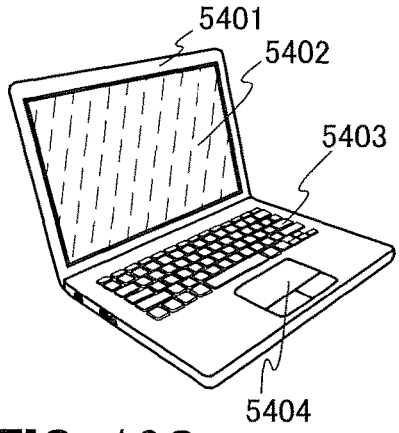
FIGS. 16A to 16F are perspective views each illustrating an example of an electronic device.

FIG. 16A illustrates a notebook personal computer including a housing 5401, a display portion 5402, a keyboard 5403, a pointing device 5404, and the like.

<Smart Watch>

Figure 16B:
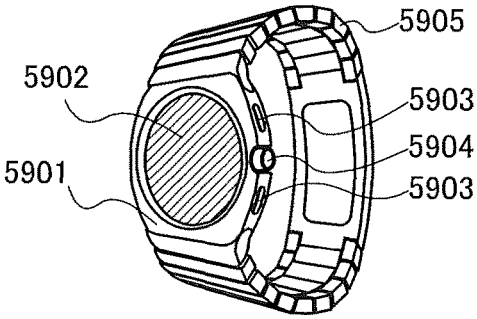

The display device of one embodiment of the present invention can be used for a wearable terminal. FIG. 16B illustrates a smart watch which is one of wearable terminals. The smart watch includes a housing 5901, a display portion 5902, operation buttons 5903, an operator 5904, and a band 5905. A display device with a position input function may be used as a display portion 5902. Note that the position input function can be added by provision of a touch panel in a display device. Alternatively, the position input function can be added by providing a photoelectric conversion element called a photosensor in a pixel area of a display device. As the operation buttons 5903, any one of a power switch for starting the smart watch, a button for operating an application of the smart watch, a volume control button, a switch for turning on or off the display portion 5902, and the like can be used. Although the smart watch in FIG. 16B includes two operation buttons 5903, the number of the operation buttons included in the smart watch is not limited to two. The operator 5904 functions as a crown performing time adjustment in the smart watch. The operator 5904 may be used as an input interface for operating an application of the smart watch as well as the crown for a time adjustment. Although the smart watch illustrated in FIG. 16B includes the operator 5904, one embodiment of the present invention is not limited thereto and the operator 5904 is not necessarily provided.

<Video Camera>

Figure 16C:
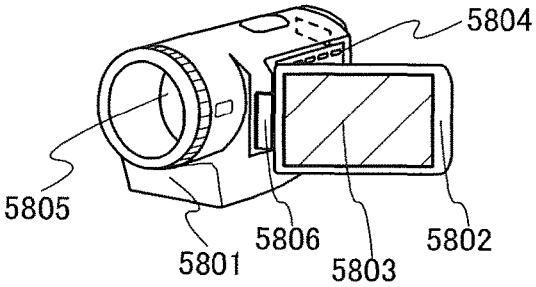

The display device of one embodiment of the present invention can be used for a video camera. FIG. 16C illustrates a video camera including a first housing 5801, a second housing 5802, a display portion 5803, operation keys 5804, a lens 5805, a joint 5806, and the like. The operation keys 5804 and the lens 5805 are provided in the first housing 5801, and the display portion 5803 is provided in the second housing 5802. The first housing 5801 and the second housing 5802 are connected to each other with the joint 5806, and the angle between the first housing 5801 and the second housing 5802 can be changed with the joint 5806. Images displayed on the display portion 5803 may be switched in accordance with the angle at the joint 5806 between the first housing 5801 and the second housing 5802.

<Mobile Phone>

Figure 16D:
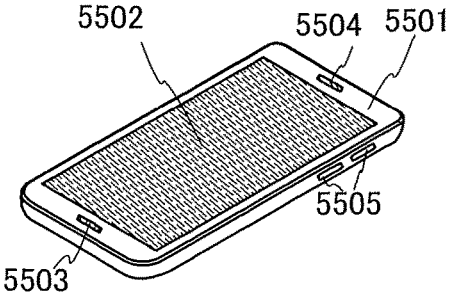

The display device of one embodiment of the present invention can be used for a mobile phone. FIG. 16D is a mobile phone having a function of an information terminal. The mobile phone includes a housing 5501, a display portion 5502, a microphone 5503, a speaker 5504, and operation buttons 5505. A display device with a position input function may be used as the display portion 5502. Note that the position input function can be added by provision of a touch panel in a display device. Alternatively, the position input function can be added by providing a photoelectric conversion element called a photosensor in a pixel area of a display device. As operation buttons 5505, any one of a power switch for starting the mobile phone, a button for operating an application of the mobile phone, a volume control button, a switch for turning on or off the display portion 5502, and the like can be used.

Although the mobile phone in FIG. 16D includes two operation buttons 5505, the number of the operation buttons included in the mobile phone is not limited to two. Although not illustrated, the mobile phone illustrated in FIG. 16D may include a light-emitting device used for a flashlight or a lighting purpose.

<Television Device>

Figure 16E:
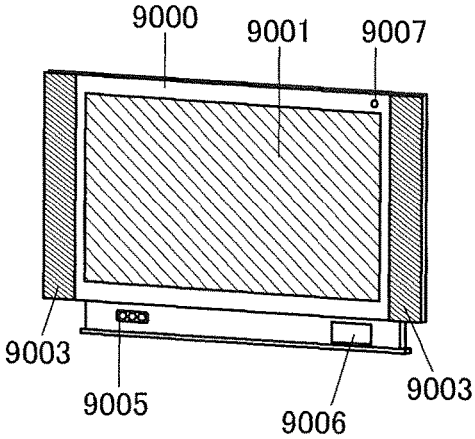

FIG. 16E is a perspective view illustrating a television device. The television device includes a housing 9000, a display portion 9001, a speaker 9003, an operation key 9005 (including a power switch or an operation switch), a connection terminal 9006, a sensor 9007 (a sensor having a function of measuring force, displacement, position, speed, acceleration, angular velocity, rotational frequency, distance, light, liquid, magnetism, temperature, chemical substance, sound, time, hardness, electric field, current, voltage, power, radiation, flow rate, humidity, gradient, oscillation, odor, or infrared rays), and the like. The television device can include the display portion 9001 having a large screen size of, for example, 50 inches or more, or 100 inches or more.

<Moving Vehicle>

The display device described above can also be used around a driver's seat in an automobile, which is a moving vehicle.

Figure 16F:
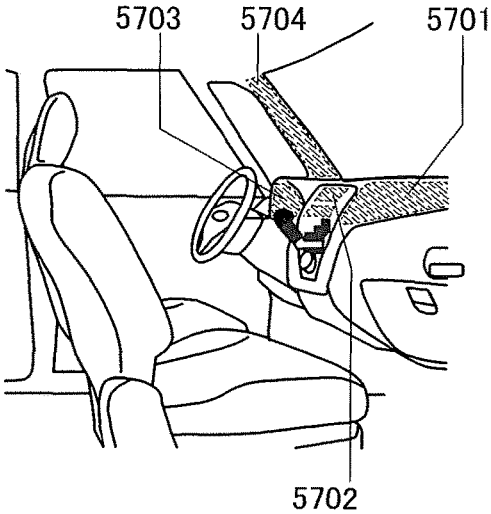

For example, FIG. 16F illustrates a front glass and its vicinity inside a car. FIG. 16F illustrates a display panel 5701, a display panel 5702, and a display panel 5703 which are attached to a dashboard, and a display panel 5704 attached to a pillar.

The display panels 5701 to 5703 can display a variety of kinds of information such as navigation information, a speedometer, a tachometer, a mileage, a fuel meter, a gear-shift indicator, air-condition setting, and the like. The content, layout, or the like of the display on the display panels can be changed freely to suit the user's preferences, so that the design can be improved. The display panels 5701 to 5703 can also be used as lighting devices.

The display panel 5704 can compensate for the view obstructed by the pillar (blind areas) by showing an image taken by an imaging means provided for the car body. That is, displaying an image taken by an imaging unit provided on the outside of the car body leads to elimination of blind areas and enhancement of safety. In addition, showing an image so as to compensate for the area which a driver cannot see makes it possible for the driver to confirm safety easily and comfortably. The display panel 5704 can also be used as a lighting device.

Although not illustrated, each of the electronic devices illustrated in FIGS. 16A, 16C, 16E, and 16F may include a microphone and a speaker. With such a structure, each of the above electronic devices can have an audio input function, for example.

Although not illustrated, each of the electronic devices illustrated in FIGS. 16A, 16B, 16D, and 16F may include a camera.

Although not illustrated, each of the electronic devices illustrated in FIGS. 16A to 16F may include a sensor (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared rays) in the housing. In particular, the direction of the mobile phone (the direction of the mobile phone with respect to the vertical direction) shown in FIG. 16D is determined by providing a sensing device which includes a sensor for sensing inclinations, such as a gyroscope sensor or an acceleration sensor, and display on the screen of the display portion 5502 can be automatically changed in accordance with the direction of the mobile phone.

Although not illustrated, each of the electronic devices illustrated in FIGS. 16A to 16F may include a device for obtaining biological information such as fingerprints, veins, iris, voice prints, or the like. With this structure, an electronic device having a biometric identification function can be provided.

For display portions of each of the electronic devices illustrated in FIGS. 16A to 16F, a flexible base may be used. Specifically, the display portion may be formed by providing a transistor, a capacitor, and a display element, for example, over a flexible base. With such a structure, in addition to the electronic devices each having the housing with a flat surface as illustrated in FIGS. 16A to 16F, an electronic device having a housing with a curved surface can be achieved.

(Notes on the Description in this Specification and the Like)

The following are notes on the structures in the above embodiments.

<Notes on One Embodiment of the Present Invention Described in Embodiments>

One embodiment of the present invention can be constituted by appropriately combining the structure described in an embodiment with any of the structures described in the other embodiments. In addition, in the case where a plurality of structure examples are described in one embodiment, some of the structure examples can be combined as appropriate.

Note that what is described (or part thereof) in an embodiment can be applied to, combined with, or replaced with another content in the same embodiment and/or what is described (or part thereof) in another embodiment or other embodiments.

Note that in each embodiment, a content described in the embodiment is a content described with reference to a variety of diagrams or a content described with text disclosed in this specification.

Note that by combining a diagram (or part thereof) described in one embodiment with another part of the diagram, a different diagram (or part thereof) described in the embodiment, and/or a diagram (or part thereof) described in another embodiment or other embodiments, much more diagrams can be formed.

<Notes on Ordinal Numbers>

In this specification and the like, ordinal numbers such as first, second, and third are used in order to avoid confusion among components. Thus, the terms do not limit the number or order of components. In the present specification and the like, a "first" component in one embodiment can be referred to as a "second" component in other embodiments or claims. Furthermore, in the present specification and the like, for example, a "first" component in one embodiment can be omitted in other embodiments or claims.

<Notes on the Description for Drawings>

However, the embodiments can be implemented with various modes. It will be readily appreciated by those skilled in the art that modes and details can be changed in various ways without departing from the spirit and scope of the present invention. Thus, the present invention should not be interpreted as being limited to the description of the embodiments. Note that in the structures of the embodiments, the same portions or portions having similar functions are denoted by the same reference numerals in different drawings, and the description of such portions is not repeated.

In this specification and the like, the terms for explaining arrangement, such as "over" and "under", are used for convenience to describe the positional relation between components with reference to drawings. Furthermore, the positional relation between components is changed as appropriate in accordance with a direction in which the components are described. Therefore, the terms for explaining arrangement are not limited to those used in this specification and may be changed to other terms as appropriate depending on the situation.

The term "over" or "under" does not necessarily mean that a component is placed directly over or directly under and directly in contact with another component. For example, the expression "electrode B over insulating layer A" does not necessarily mean that the electrode B is on and in direct contact with the insulating layer A and can mean the case where another component is provided between the insulating layer A and the electrode B.

In drawings, the size, the layer thickness, or the region is determined arbitrarily for description convenience. Therefore, the size, the layer thickness, or the region is not limited to the illustrated scale. Note that the drawings are schematically shown for clarity, and embodiments of the present invention are not limited to shapes or values shown in the drawings. For example, the following can be included: variation in signal, voltage, or current due to noise or difference in timing.

In drawings such as a perspective view, some components might not be illustrated for clarity of the drawings.

In the drawings, the same components, components having similar functions, components formed of the same material, or components formed at the same time are denoted by the same reference numerals in some cases, and the description thereof is not repeated in some cases.

<Notes on Expressions that can be Rephrased>

In this specification or the like, the terms "one of a source and a drain" (or a first electrode or a first terminal) and "the other of the source and the drain" (or a second electrode or a second terminal) are used to describe the connection relation of a transistor. This is because a source and a drain of a transistor are interchangeable depending on the structure, operation conditions, or the like of the transistor. Note that the source or the drain of the transistor can also be referred to as a source (or drain) terminal, a source (or drain) electrode, or the like as appropriate depending on the situation. In this specification and the like, two terminals except a gate are sometimes referred to as a first terminal and a second terminal or as a third terminal and a fourth terminal. In this specification and the like, in the case where a transistor has two or more gates (such a structure is referred to as a dual-gate structure in some cases), these gates are referred to as a first gate and a second gate or a front gate and a back gate in some cases. In particular, the term "front gate" can be replaced with a simple term "gate". The term "back gate" can be replaced with a simple term "gate". Note that a "bottom gate" is a terminal which is formed before a channel formation region in manufacture of a transistor, and a "top gate" is a terminal which is formed after a channel formation region in manufacture of a transistor.

A transistor is an element having three terminals: a gate, a source, and a drain. A gate is a terminal which functions as a control terminal for controlling the conduction state of a transistor. Functions of input/output terminals of the transistor depend on the type and the levels of potentials applied to the terminals, and one of the two terminals serves as a source and the other serves as a drain. Therefore, the terms "source" and "drain" can be switched in this specification and the like. In this specification and the like, two terminals except a gate are sometimes referred to as a first terminal and a second terminal or as a third terminal and a fourth terminal.

In addition, in this specification and the like, the term such as an "electrode" or a "wiring" does not limit a function of the component. For example, an "electrode" is used as part of a "wiring" in some cases, and vice versa. Further, the term "electrode" or "wiring" can also mean a combination of a plurality of "electrodes" and "wirings" formed in an integrated manner.

In this specification and the like, "voltage" and "potential" can be replaced with each other. The term "voltage" refers to a potential difference from a reference potential. When the reference potential is a ground potential, for example, "voltage" can be replaced with "potential". The ground potential does not necessarily mean 0 V. Potentials are relative values, and the potential applied to a wiring or the like is changed depending on the reference potential, in some cases.

In this specification and the like, the terms "film" and "layer" can be interchanged with each other depending on the case or circumstances. For example, the term "conductive layer" can be changed into the term "conductive film" in some cases. Also, the term "insulating film" can be changed into the term "insulating layer" in some cases. Moreover, the term "insulating film" can be changed into the term "insulating layer" in some cases, or can be replaced with a word not including the term "film" or "layer" depending on the case or circumstances. For example, the term "conductive layer" or "conductive film" can be changed into the term "conductor" in some cases. Furthermore, for example, the term "insulating layer" or "insulating film" can be changed into the term "insulator" in some cases.

In this specification and the like, the terms "wiring," "signal line," "power supply line," and the like can be interchanged with each other depending on circumstances or conditions. For example, the term "wiring" can be changed into the term such as "signal line" or "power source line" in some cases. The term such as "signal line" or "power source line" can be changed into the term "wiring" in some cases. The term such as "power source line" can be changed into the term such as "signal line" in some cases. The term such as "signal line" can be changed into the term such as "power source line" in some cases. The term "potential" that is applied to a wiring can be changed into the term "signal" or the like depending on circumstances or conditions. Inversely, the term "signal" or the like can be changed into the term "potential" in some cases.

<Notes on Definitions of Terms>

The following are definitions of the terms mentioned in the above embodiments.

<<Impurity in Semiconductor>>

Note that an impurity in a semiconductor refers to, for example, elements other than the main components of a semiconductor layer. For example, an element with a concentration lower than 0.1 atomic % is an impurity. When an impurity is contained, the density of states (DOS) may be formed in a semiconductor, the carrier mobility may be decreased, or the crystallinity may be decreased. In the case where the semiconductor is an oxide semiconductor, examples of an impurity which changes characteristics of the semiconductor include Group 1 elements, Group 2 elements, Group 13 elements, Group 14 elements, Group 15 elements, and transition metals other than the main components of the semiconductor; specifically, there are hydrogen (included in water), lithium, sodium, silicon, boron, phosphorus, carbon, and nitrogen, for example. When the semiconductor is an oxide semiconductor, oxygen vacancies may be formed by entry of impurities such as hydrogen, for example. Furthermore, when the semiconductor layer is silicon, examples of an impurity which changes the characteristics of the semiconductor include oxygen, Group 1 elements except hydrogen, Group 2 elements, Group 13 elements, and Group 15 elements.

<<Transistor>>

In this specification, a transistor is an element having at least three terminals of a gate, a drain, and a source. The transistor has a channel formation region between the drain (a drain terminal, a drain region, or a drain electrode) and the source (a source terminal, a source region, or a source electrode). A voltage is applied between a gate and the source, whereby current can flow between the drain and the source.

Furthermore, functions of a source and a drain might be switched when transistors having different polarities are employed or a direction of current flow is changed in circuit operation, for example. Therefore, the terms "source" and "drain" can be switched in this specification and the like.

<<Switch>>

In this specification and the like, a switch is conducting (on state) or not conducting (off state) to determine whether current flows therethrough or not. Alternatively, a switch has a function of selecting and changing a current path.

Examples of a switch are an electrical switch, a mechanical switch, and the like. That is, any element can be used as a switch as long as it can control current, without limitation to a certain element.

Examples of the electrical switch are a transistor (e.g., a bipolar transistor or a MOS transistor), a diode (e.g., a PN diode, a PIN diode, a Schottky diode, a metal-insulator-metal (MIM) diode, a metal-insulator-semiconductor (MIS) diode, or a diode-connected transistor), and a logic circuit in which such elements are combined.

In the case of using a transistor as a switch, an "on state" of the transistor refers to a state in which a source electrode and a drain electrode of the transistor are electrically short-circuited. Furthermore, an "off state" of the transistor refers to a state in which the source electrode and the drain electrode of the transistor are electrically cut off. In the case where a transistor operates just as a switch, the polarity (conductivity type) of the transistor is not particularly limited to a certain type.

An example of a mechanical switch is a switch formed using a micro electro mechanical systems (MEMS) technology, such as a digital micromirror device (DMD). Such a switch includes an electrode which can be moved mechanically, and operates by controlling conduction and non-conduction in accordance with movement of the electrode.

<<Connection>>

In this specification and the like, when it is described that X and Y are connected, the case where X and Y are electrically connected, the case where X and Y are functionally connected, and the case where X and Y are directly connected are included therein. Accordingly, another element may be interposed between elements having a connection relation shown in drawings and texts, without limiting to a predetermined connection relation, for example, the connection relation shown in the drawings and the texts.

Here, X, Y, and the like each denote an object (e.g., a device, an element, a circuit, a wiring, an electrode, a terminal, a conductive film, a layer, or the like).

For example, in the case where X and Y are electrically connected, one or more elements that enable an electrical connection between X and Y (e.g., a switch, a transistor, a capacitor, an inductor, a resistor, a diode, a display element, a light-emitting element, or a load) can be connected between X and Y. Note that the switch is controlled to be turned on or off. That is, a switch is conducting or not conducting (is turned on or off) to determine whether current flows therethrough.

For example, in the case where X and Y are functionally connected, one or more circuits that enable functional connection between X and Y (e.g., a logic circuit such as an inverter, a NAND circuit, or a NOR circuit; a signal converter circuit such as a DA converter circuit, an AD converter circuit, or a gamma correction circuit; a potential level converter circuit such as a power source circuit (e.g., a step-up converter or a step-down converter) or a level shifter circuit for changing the potential level of a signal; a voltage source; a current source; a switching circuit; an amplifier circuit such as a circuit that can increase signal amplitude, the amount of current, or the like, an operational amplifier, a differential amplifier circuit, a source follower circuit, or a buffer circuit; a signal generation circuit; a memory circuit; and/or a control circuit) can be connected between X and Y. For example, even when another circuit is interposed between X and Y, X and Y are functionally connected if a signal output from X is transmitted to Y.

Note that when it is explicitly described that X and Y are connected, the case where X and Y are electrically connected (i.e., the case where X and Y are connected with another element or another circuit provided therebetween), the case where X and Y are functionally connected (i.e., the case where X and Y are functionally connected with another circuit provided therebetween), and the case where X and Y are directly connected (i.e., the case where X and Y are connected without another element or another circuit provided therebetween) are included therein. That is, the explicit expression "X and Y are electrically connected" is the same as the explicit simple expression "X and Y are connected".

For example, any of the following expressions can be used for the case where a source (or a first terminal or the like) of a transistor is electrically connected to X through (or not through) Z1 and a drain (or a second terminal or the like) of the transistor is electrically connected to Y through (or not through) Z2, or the case where a source (or a first terminal or the like) of a transistor is directly connected to one part of Z1 and another part of Z1 is directly connected to X while a drain (or a second terminal or the like) of the transistor is directly connected to one part of Z2 and another part of Z2 is directly connected to Y.

The expressions include, for example, "X, Y, a source (or a first terminal or the like) of a transistor, and a drain (or a second terminal or the like) of the transistor are electrically connected to each other, and X, the source (or the first terminal or the like) of the transistor, the drain (or the second terminal or the like) of the transistor, and Y are electrically connected to each other in this order", "a source (or a first terminal or the like) of a transistor is electrically connected to X a drain (or a second terminal or the like) of the transistor is electrically connected to Y, and X, the source (or the first terminal or the like) of the transistor, the drain (or the second terminal or the like) of the transistor, and Y are electrically connected to each other in this order", and "X is electrically connected to Y through a source (or a first terminal or the like) and a drain (or a second terminal or the like) of a transistor, and X, the source (or the first terminal or the like) of the transistor, the drain (or the second terminal or the like) of the transistor, and Y are provided to be connected in this order". When the connection order in a circuit configuration is defined by an expression similar to the above examples, a source (or a first terminal or the like) and a drain (or a second terminal or the like) of a transistor can be distinguished from each other to specify the technical scope. Note that these expressions are examples and there is no limitation on the expressions. Here, X, Y, Z1, and Z2 each denote an object (e.g., a device, an element, a circuit, a wiring, an electrode, a terminal, a conductive film, and a layer).

Even when independent components are electrically connected to each other in a circuit diagram, one component has functions of a plurality of components in some cases. For example, when part of a wiring also functions as an electrode, one conductive film functions as the wiring and the electrode. Thus, "electrical connection" in this specification includes in its category such a case where one conductive film has functions of a plurality of components.

<<Parallel and Perpendicular>>

In this specification, the term "parallel" indicates that the angle formed between two straight lines is greater than or equal to −10° and less than or equal to 10°, and accordingly also includes the case where the angle is greater than or equal to −5° and less than or equal to 5°. In addition, the term "substantially parallel" indicates that the angle formed between two straight lines is greater than or equal to −30° and less than or equal to 30°. The term "perpendicular" indicates that the angle formed between two straight lines is greater than or equal to 80° and less than or equal to 100°. Thus, the case where the angle is greater than or equal to 85° and less than or equal to 95° is also included. In addition, the term "substantially perpendicular" indicates that the angle formed between two straight lines is greater than or equal to 60° and less than or equal to 120°.

This application is based on Japanese Patent Application Serial No. 2016-218498 filed with Japan Patent Office on Nov. 9, 2016, the entire contents of which are hereby incorporated by reference.

What is claimed is:

1. An operation method of an electronic device comprising a first display element, a second display element, a first circuit, and an optical sensor, comprising:

measuring an illuminance of external light by the optical sensor;

transmitting an illuminance data including the illuminance of external light to the first circuit;

obtaining a first data and a second data by the first circuit;

setting a first gain value to 0 by the first circuit and determining a second gain value with use of a first function and the illuminance of external light by the first circuit when the illuminance of external light in the first circuit is lower than a first illuminance;

determining the first gain value with use of a second function and the illuminance of external light by the first circuit and determining the second gain value with use of a third function and the illuminance of external light by the first circuit when the illuminance of external light in the first circuit is higher than or equal to the first illuminance and lower than a second illuminance;

determining the first gain value with use of a fourth function and the illuminance of external light by the first circuit and setting the second gain value to 0 by the first circuit when the illuminance of external light in the first circuit is higher than or equal to the second illuminance;

multiplying the first data by the first gain value or a value corresponding to the first gain value to generate a third data in the first circuit and multiplying the second data by the second gain value or a value corresponding to the second gain value to generate a fourth data in the first circuit after the first gain value and the second gain value are determined; and displaying an image based on the third data using the first display element and an image based on the fourth data using the second display element.

2. The operation method according to claim 1, wherein at least one of the first to fourth functions is a linear function.

3. The operation method according to claim 2, further comprising:

setting the first gain value determined with use of the second function or the fourth function to a first maximum value when the first gain value is greater than or equal to the first maximum value; and setting the second gain value determined with use of the first function or the third function to a second maximum value when the second gain value is greater than or equal to the second maximum value, wherein multiplying the first data by the first gain value or a value corresponding to the first gain value and multiplying the second data by the second gain value or a value corresponding to the second gain value are conducted after setting the first gain value to the first maximum value and setting the second gain value to the second maximum value.

4. The operation method according to claim 3, further comprising:

performing a correction processing on one of the first data and the third data and one of the second data and the fourth data by a second circuit included in the electronic device.

5. The operation method according to claim 4, wherein the correction processing comprises a gamma correction processing.

6. The operation method according to claim 1, wherein the first display element is a reflective element, and wherein the second display element is a light-emitting element.

7. The operation method according to claim 1, wherein each of the first to fourth functions is a monotonic increasing function.

8. An operation method of an electronic device comprising a first display element, a second display element, a first circuit, and an optical sensor, comprising:

measuring an illuminance of external light by the optical sensor;

transmitting an illuminance data including the illuminance of external light to the first circuit;

obtaining a first data and a second data by the first circuit;

determining a first gain value with use of a first function and the illuminance of external light and determining a second gain value with use of a second function and the illuminance of external light;

multiplying the first data by the first gain value or a value corresponding to the first gain value to generate a third data in the first circuit;

multiplying the second data by the second gain value or a value corresponding to the second gain value to generate a fourth data in the first circuit;

displaying an image based on the third data using the first display element and an image based on the fourth data using the second display element, wherein the first function is different from the second function, and wherein, when the illuminance of external light in the first circuit is lower than a first illuminance, the first gain value is set to 0, and the second gain value is determined with use of the second function and the illuminance of external light.

9. The operation method according to claim 8, further comprising:

performing a correction processing on one of the first data and the third data and one of the second data and the fourth data by a second circuit.

10. The operation method according to claim 9, wherein the correction processing comprises a gamma correction processing.

11. The operation method according to claim 8,
wherein the first display element is a reflective element, and
wherein the second display element is a light-emitting element.

12. The operation method according to claim 8,
wherein the first function is a linear function, and
wherein the second function is a linear function.

13. The operation method according to claim 8,
wherein the first display element is a reflective element, and
wherein the second display element is an organic EL, inorganic EL, or a nitride semiconductor light-emitting diode.

* * * * *